US008690315B2

(12) United States Patent
Horade

(10) Patent No.: US 8,690,315 B2
(45) Date of Patent: Apr. 8, 2014

(54) IMAGE RECORDING APPARATUS AND IMAGE RECORDING METHOD

(75) Inventor: Kenta Horade, Tokai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 123 days.

(21) Appl. No.: 13/363,303

(22) Filed: Jan. 31, 2012

(65) Prior Publication Data

US 2012/0249707 A1 Oct. 4, 2012

(30) Foreign Application Priority Data

Mar. 28, 2011 (JP) ..... 2011-069590

(51) Int. Cl.
*B41J 2/01* (2006.01)

(52) U.S. Cl.
USPC ..... 347/104; 347/16

(58) Field of Classification Search
CPC ..... B41J 2/01; B41J 11/50; B41J 11/51; B41J 19/94; B41J 15/18; B41J 15/20; B41J 15/22; B41J 15/24
USPC ..... 347/16, 37, 104
See application file for complete search history.

(56) References Cited

U.S. PATENT DOCUMENTS

| | | | | |
|---|---|---|---|---|
| 6,775,022 | B2 * | 8/2004 | Noyes et al. | 358/1.15 |
| 2008/0157460 | A1 * | 7/2008 | Izuchi et al. | 271/109 |
| 2009/0035018 | A1 | 2/2009 | Koga et al. | |
| 2009/0035019 | A1 | 2/2009 | Koga et al. | |

FOREIGN PATENT DOCUMENTS

| | | | |
|---|---|---|---|
| JP | H08-221230 | A | 8/1996 |
| JP | 2003-034454 | A | 2/2003 |
| JP | 2004-255724 | A | 9/2004 |
| JP | 2005-280923 | A | 10/2005 |
| JP | 2008-162736 | A | 7/2008 |
| JP | 2009-034832 | A | 2/2009 |
| JP | 2012-001334 | A | 1/2012 |

OTHER PUBLICATIONS

Japan Patent Office, Notification of Reasons for Refusal for Japanese Patent Application No. 2011-069590 (counterpart to above-captioned patent application), mailed Jul. 30, 2013.

* cited by examiner

*Primary Examiner* — Julian Huffman
*Assistant Examiner* — Sharon A Polk
(74) *Attorney, Agent, or Firm* — Baker Botts L.L.P.

(57) ABSTRACT

An image recording apparatus including: first and second trays on each of which a recording medium is placed; first and second rollers respectively for the first and second trays; a recording head mounted on a carriage; a drive source; a switching portion switchable to a first posture and a second posture by its contact with the carriage to change transmission of a drive power of the drive source; and a control section configured, where a switching processing is required for switching a target of the transmission of the drive power by moving the carriage to contact the switching portion to change its posture, to start the switching processing in image recording on one recording medium and then to execute a forward and reverse rotation processing for rotating the drive source forwardly and reversely.

11 Claims, 12 Drawing Sheets

IMAGE RECORDING APPARATUS AND IMAGE RECORDING METHOD

CROSS REFERENCE TO RELATED APPLICATION

The present application claims priority from Japanese Patent Application No. 2011-069590, which was filed on Mar. 28, 2011, the disclosure of which is herein incorporated by reference in its entirety.

BACKGROUND OF THE INVENTION

1. Field of the Invention

The present invention relates to an image recording apparatus and an image recording method for recording an image on a recording medium.

2. Description of the Related Art

There is conventionally known an image recording apparatus configured to supply a recording medium such as a recording sheet from a sheet-supply tray by a sheet-supply roller and record an image by ejecting ink onto the supplied recording medium. In such an image recording apparatus, conveyance roller pairs convey the supplied recording medium, and a recording head mounted on a carriage reciprocable in a main scanning direction selectively ejects the ink onto the stopped recording medium to record an image thereon.

One type of the image recording apparatus includes an image recording apparatus including two sheet-supply trays and first and second sheet-supply rollers provided for the respective two sheet-supply trays and driven by one drive source (e.g., a drive motor) to selectively supply a sheet from one of the two sheet-supply trays. As the image recording apparatus of this type, there is known an image recording apparatus including a power transmission switching mechanism for switching power transmission to the first sheet-supply roller and the second sheet-supply roller.

Here, one example of this power transmission switching operation for the two sheet-supply rollers is explained. Initially, the carriage presses and slides a switching gear such that the switching gear takes a first posture or a second posture. It is noted that the switching gear is always meshed with a drive gear that is driven by the drive motor. When the switching gear slid by the carriage meshes with a first receiving gear or a second receiving gear having not been meshed with the switching gear, the switching gear needs to repeat slight forward and reverse rotation. This slight forward and reverse rotation disengages the switching gear from the first receiving gear or the second receiving gear having been meshed with the switching gear before the switching or meshes the switching gear with the first receiving gear or the second receiving gear. As a result, the drive gear is driven selectively for a first transmitter or a second transmitter, and the power transmission switching operation is completed. It is noted that the rotation of the first receiving gear is transmitted to the first transmitter that is meshed with the first sheet-supply roller while the rotation of the second receiving gear is transmitted to the second transmitter that is meshed with the second sheet-supply roller. In view of the above, the completion of the power transmission switching operation requires not only the slide of the carriage but also the forward and reverse rotation of the switching gear.

SUMMARY OF THE INVENTION

The above-described technique requires a time for completing the power transmission switching operation in addition to a time for the conveyance by the conveyance roller pairs and a time for the recording operation by the recording head on the stopped sheet. In this case, when the image is recorded on a plurality of recording media and when it has been judged that the power transmission switching operation is required in the recording operation, the time for the power transmission switching operation is required in addition to the time for the recording operation. Thus, an unnecessary time occurs from an end of a current recording operation to a start of the next recording operation on the next recording medium.

This invention has been developed to provide an image recording apparatus and an image recording method capable of shortening a time from a current recording operation to a recording operation on a next recording medium.

The present invention provides an image recording apparatus, comprising: a first sheet-supply tray and a second sheet-supply tray on each of which a recording medium is placed; a first sheet-supply roller rotatable to supply the recording medium placed on the first sheet-supply tray; a second sheet-supply roller rotatable to supply the recording medium placed on the second sheet-supply tray; a conveyor configured to convey the recording medium supplied from one of the first sheet-supply roller and the second sheet-supply roller in a conveyance direction; a recording head configured to eject ink onto the recording medium conveyed by the conveyor; a carriage reciprocable in a main scanning direction perpendicular to the conveyance direction, the recording head being mounted on the carriage; a drive source configured to generate a drive power by rotating in a forward direction and in a reverse direction; a switching portion provided outside a recording area in the main scanning direction, the recording area being an area through which the recording medium conveyed by the conveyor passes, a posture of the switching portion being switchable to a first posture and a second posture different from the first posture by contact of the carriage moving in the main scanning direction with the switching portion, the drive power of the drive source being received by the switching portion being in the first posture or the second posture; a first drive-power transmitting mechanism configured to transmit the drive power of the drive source to the first sheet-supply roller via the switching portion when the switching portion is in the first posture; a second drive-power transmitting mechanism configured to transmit the drive power of the drive source to the second sheet-supply roller via the switching portion when the switching portion is in the second posture; an image-recording processing section configured to control the recording head, the carriage, and the conveyor to execute an image recording processing for recording an image on the recording medium on the basis of image data; a switching processing section configured to execute a switching processing for switching a target of the transmission of the drive power of the drive source from the first drive-power transmitting mechanism to the second drive-power transmitting mechanism or from the second drive-power transmitting mechanism to the first drive-power transmitting mechanism by moving the carriage to contact the switching portion to change a posture of the switching portion; a forward-and-reverse-rotation processing section configured to execute a forward and reverse rotation processing for rotating the drive source in the forward direction and the reverse direction; a switching-processing-requirement judging section configured to judge whether the switching processing section needs to execute the switching processing in the image recording processing on one recording medium by the image-recording processing section, where the image recording processing is executed on a plurality of recording media; and a control section configured, where the switching-processing-requirement judging section has judged that the switching processing section needs to execute the switching processing, to control the switching processing section to start the switching processing in the image recording processing on the one recording medium by the image-recording processing section and then to control the forward-and-reverse-rotation processing section to execute the forward and reverse rotation processing.

The present invention provides An image recording method executed by an image recording apparatus, the image recording apparatus comprising: a first sheet-supply tray and a second sheet-supply tray on each of which a recording medium is placed; a first sheet-supply roller rotatable to supply the recording medium placed on the first sheet-supply tray; a second sheet-supply roller rotatable to supply the recording medium placed on the second sheet-supply tray; a conveyor configured to convey the recording medium supplied from one of the first sheet-supply roller and the second sheet-supply roller in a conveyance direction; a recording head configured to eject ink onto the recording medium conveyed by the conveyor; a carriage reciprocable in a main scanning direction perpendicular to the conveyance direction, the recording head being mounted on the carriage; a drive source configured to generate a drive power by rotating in a forward direction and in a reverse direction; a switching portion provided outside a recording area in the main scanning direction, the recording area being an area through which the recording medium conveyed by the conveyor passes, a posture of the switching portion being switchable to a first posture and a second posture different from the first posture by contact of the carriage moving in the main scanning direction with the switching portion, the drive power of the drive source being received by the switching portion being in the first posture or the second posture; a first drive-power transmitting mechanism configured to transmit the drive power of the drive source to the first sheet-supply roller via the switching portion when the switching portion is in the first posture; a second drive-power transmitting mechanism configured to transmit the drive power of the drive source to the second sheet-supply roller via the switching portion when the switching portion is in the second posture; an image-recording processing section configured to control the recording head, the carriage, and the conveyor to execute an image recording processing for recording an image on the recording medium on the basis of image data; a switching processing section configured to execute a switching processing for switching an object to transmit the drive power of the drive source, from the first drive-power transmitting mechanism to the second drive-power transmitting mechanism or from the second drive-power transmitting mechanism to the first drive-power transmitting mechanism by moving the carriage to contact the switching portion to change a posture of the switching portion; and a forward-and-reverse-rotation processing section configured to execute a forward and reverse rotation processing for rotating the drive source in the forward direction and the reverse direction, wherein the image recording method comprises: judging the switching processing section needs to execute the switching processing in the image recording processing on one recording medium by the image-recording processing section, where the image recording processing is executed on a plurality of recording media; where it has been judged that the switching processing section needs to execute the switching processing, controlling the switching processing section to start the switching processing in the image recording processing on the one recording medium by the image-recording processing section and then controlling the forward-and-reverse-rotation processing section to execute the forward and reverse rotation processing.

The present invention provides An image recording apparatus, comprising: a first sheet-supply tray and a second sheet-supply tray on each of which a recording medium is placed; a first sheet-supply roller rotatable to supply the recording medium placed on the first sheet-supply tray; a second sheet-supply roller rotatable to supply the recording medium placed on the second sheet-supply tray; a conveyor configured to convey the recording medium supplied from one of the first sheet-supply roller and the second sheet-supply roller in a conveyance direction; a recording head configured to eject ink onto the recording medium conveyed by the conveyor; a carriage reciprocable in a main scanning direction perpendicular to the conveyance direction, the recording head being mounted on the carriage; a drive source configured to generate a drive power by rotating in a forward direction and in a reverse direction; a switching portion provided outside a recording area in the main scanning direction, the recording area being an area through which the recording medium conveyed by the conveyor passes, a posture of the switching portion being switchable to a first posture and a second posture different from the first posture by contact of the carriage moving in the main scanning direction with the switching portion, the drive power of the drive source being received by the switching portion being in the first posture or the second posture; a first drive-power transmitting mechanism configured to transmit the drive power of the drive source to the first sheet-supply roller via the switching portion when the switching portion is in the first posture; a second drive-power transmitting mechanism configured to transmit the drive power of the drive source to the second sheet-supply roller via the switching portion when the switching portion is in the second posture; an image-recording processing section configured to control the recording head, the carriage, and the conveyor to execute an image recording processing for recording an image on the recording medium on the basis of image data; a switching processing section configured to execute a, switching processing for switching an object to transmit the drive power of the drive source, from the first drive-power transmitting mechanism to the second drive-power transmitting mechanism or from the second drive-power transmitting mechanism to the first drive-power transmitting mechanism by moving the carriage to contact the switching portion to change a posture of the switching portion; a forward-and-reverse-rotation processing section configured to execute a forward and reverse rotation processing for rotating the drive source in the forward direction and the reverse direction; a control section configured to control the switching processing section to start the switching processing in the image recording processing on the one recording medium by the image-recording processing section and then to control the forward-and-reverse-rotation processing section to execute the forward and reverse rotation processing.

BRIEF DESCRIPTION OF THE DRAWINGS

The objects, features, advantages, and technical and industrial significance of the present invention will be better understood by reading the following detailed description of embodiments of the invention, when considered in connection with the accompanying drawings, in which:

FIGS. 3A and 3B are views showing a maintenance mechanism 60, wherein FIG. 3A is a plan view of the maintenance mechanism 60, and FIG. 3B is a cross-sectional view taken along line IIIB-IIIB in FIG. 3A;

DETAILED DESCRIPTION OF THE EMBODIMENTS

Hereinafter, there will be described embodiments of the present invention by reference to the drawings.

<First Embodiment>

Figure 1:
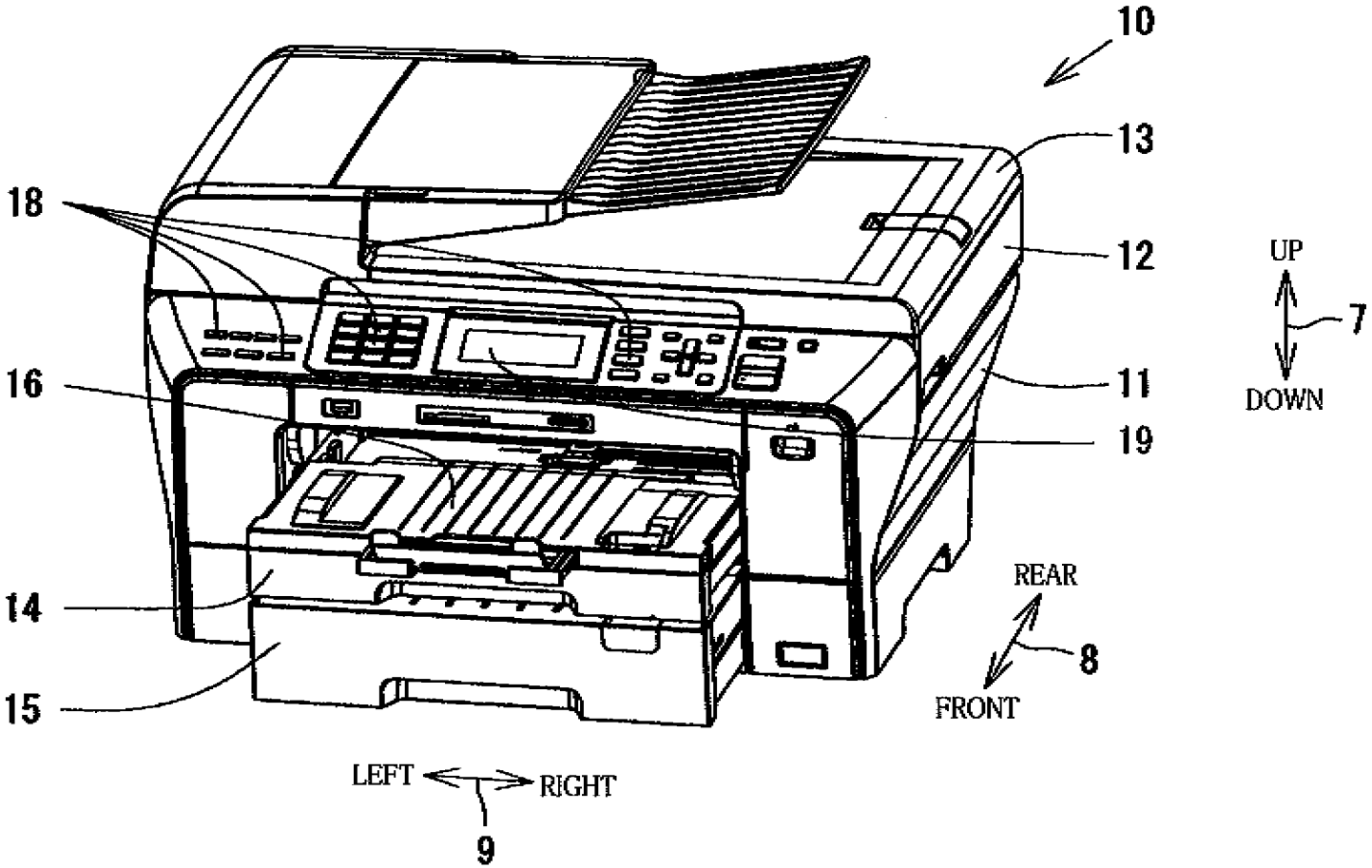
FIG. 1 is a perspective view showing an MFD 10 as a first embodiment.

FIG. 1 shows a multi-function device (MFD) 10 having various functions such as recording, scanning, copying, and facsimile functions, as a first embodiment of an image recording apparatus to which the present invention is applied. The MFD 10 has a generally rectangular parallelepiped shape. In the following explanation, a height direction of the MFD 10 is defined as an upward and downward direction 7, a depth direction thereof is defined as a frontward and rearward direction 8, and a widthwise direction thereof is defined as a rightward and leftward direction 9.

<Overall Construction of MFD 10>

The MFD 10 includes a printer casing 11; a scanner casing 12 disposed on the upper side of the printer casing 11 and accommodating a scanning section; and a document cover 13 disposed on the upper side of the scanner casing 12. The printer casing 11 accommodates in its lower portion (a) an upper tray 14 (as one example of a first sheet-supply tray) and (b) a lower tray 15 (as one example of a second sheet-supply tray) which are pulled frontward by a user and on each of which a recording medium (media) in the form of a sheet(s) 5 such as a plain paper, a glossy paper, and a post card paper is stacked. The printer casing 11 accommodates in its upper portion a printing section 17 (see FIG. 2) configured to record an image on the sheets 5. A sheet-discharge tray 16 is placed on the upper tray 14. Various sizes of the sheet (up to A3 size sheet, for example) can be set on the upper tray 14 and the lower tray 15.

Figure 9:
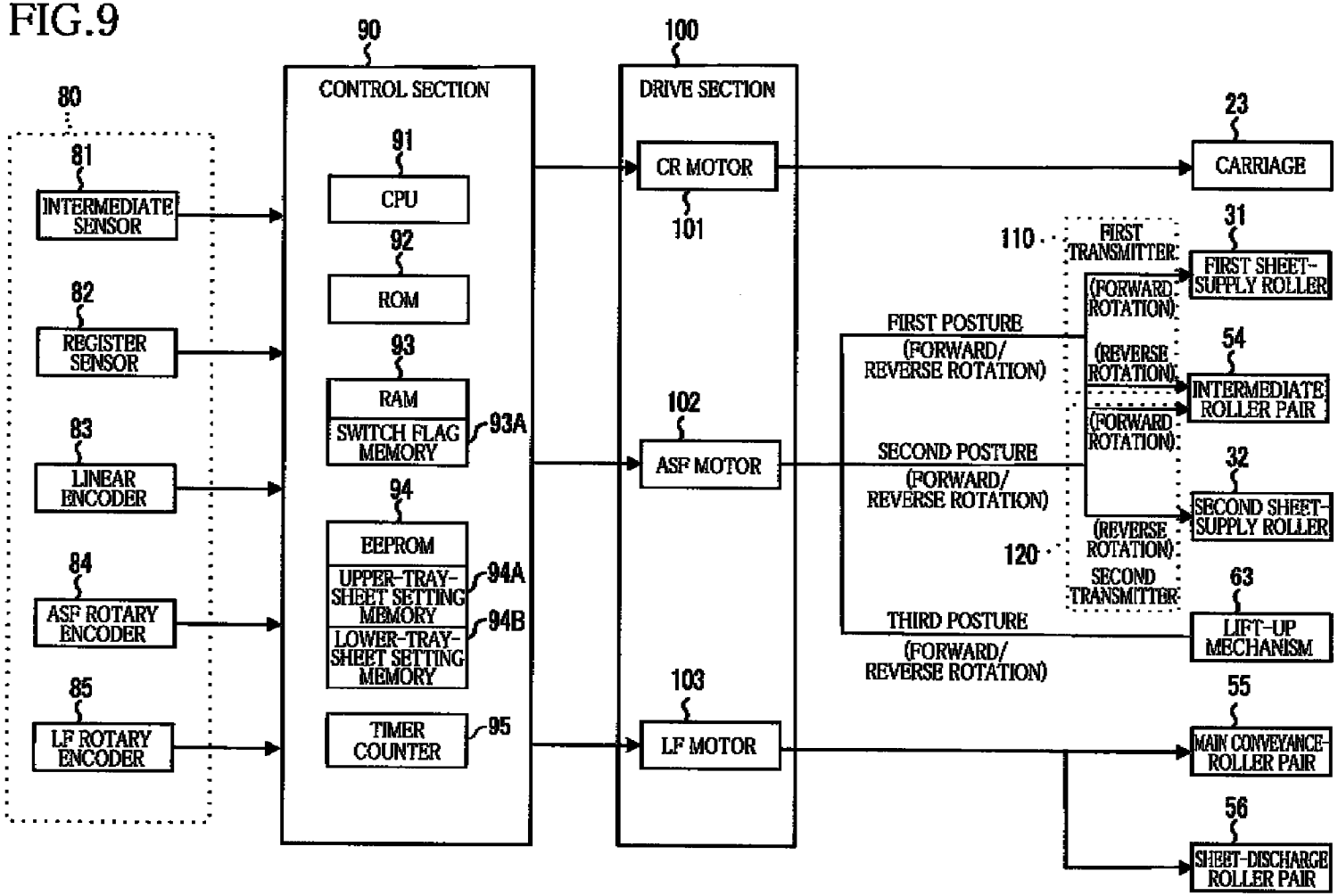
FIG. 9 is a block diagram showing a configuration of a control section 90.

The scanning section and the printing section 17 are controlled by a control section 90 shown in FIG. 9. The control section 90 is provided by various electronic components such as a microcomputer mounted on a board, for example. The control section 90 controls image capture and image recording based on a signal inputted from one or more of input buttons 18 shown in FIG. 1 or an external device such as a PC and controls a display 19 to display thereon information required for the image recording.

<Printing Section 17>

Figure 2:
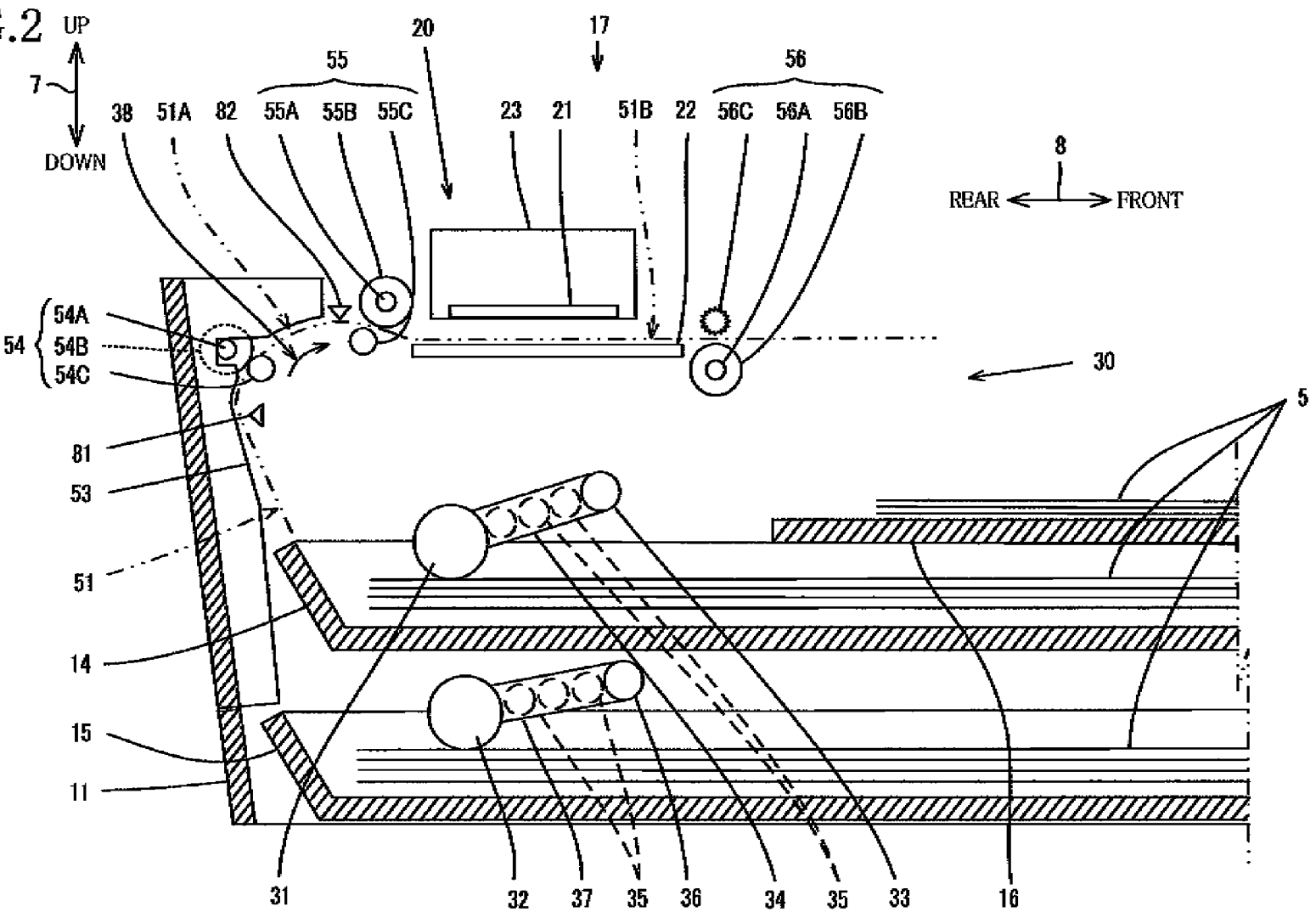
FIG. 2 is a cross-sectional view schematically showing a printing section 17.

As shown in FIG. 2, the printing section 17 includes: a conveyance device 30 configured to convey each sheet 5 placed on the upper tray 14 and the lower tray 15; a recording portion 20 configured to record the image on the sheet 5 conveyed by the conveyance device 30; a drive section 100 (see FIG. 9) and a power transmission switching mechanism 40 (see FIG. 4); a sensing mechanism 80; and a maintenance mechanism 60 (see FIG. 3) for maintaining the recording portion 20.

<Recording Portion 20>

As shown in FIG. 2, the recording portion 20 includes: a plate-like platen 22 disposed on an upper side of a rear portion of the upper tray 14; a recording head 21 disposed on an upper side of the platen 22 so as to be opposed to the platen 22; and a carriage 23 for holding the recording head 21.

The recording head 21 has a multiplicity of nozzles, not shown. Each of the nozzles has an ejection opening opening downward. An ink droplet is ejected downward from the nozzle toward the platen 22 by deformation caused by a piezoelectric element, for example. A component such as a flexible cable is used for supplying an electric power to the piezoelectric element, which is controlled by the control section 90 (see FIG. 9).

The carriage 23 bridges a pair of front and rear guide rails 24 (see FIG. 4) arranged on an upper side of the platen 22, such that the carriage 23 is supported by the guide rails 24 so as to be movable in the rightward and leftward direction 9. Each of the guide rails 24 has a plate-like shape elongated in the rightward and leftward direction 9 and is supported by a frame 25. The carriage 23 is provided with a contact piece 26 (see FIG. 5) for gear change of the power transmission switching mechanism 40. The contact piece 26 projects rightward from a right end portion of the carriage 23.

<Maintenance Mechanism 60>

Figure 3A:
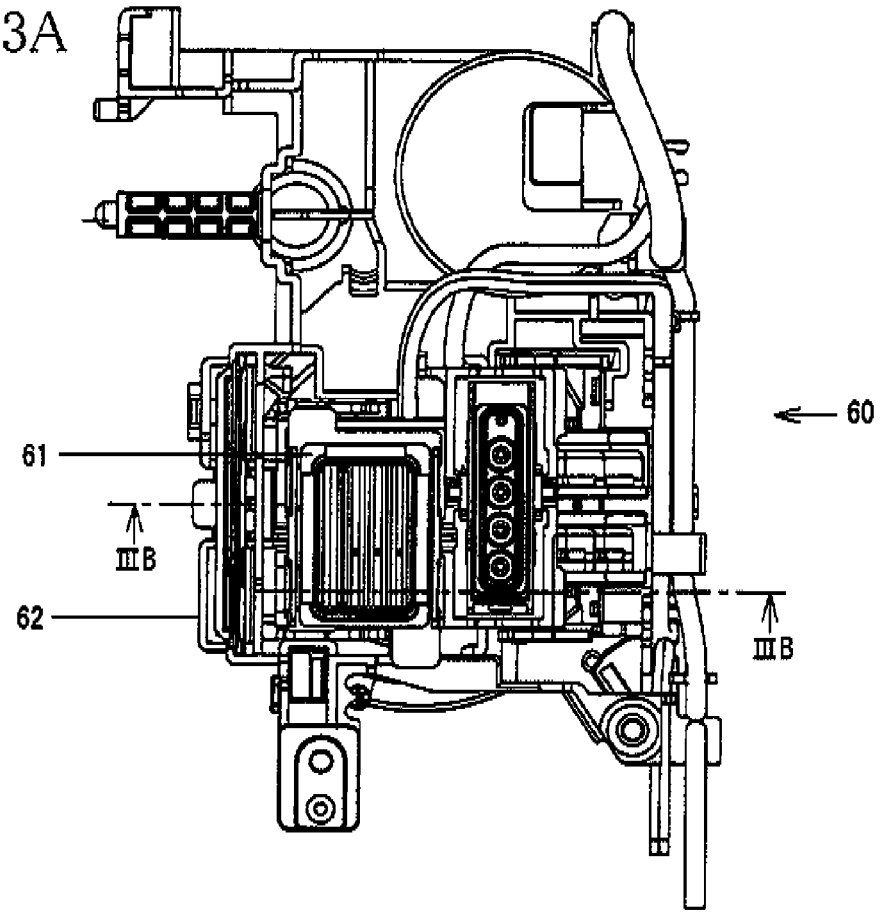
Figure 3B:
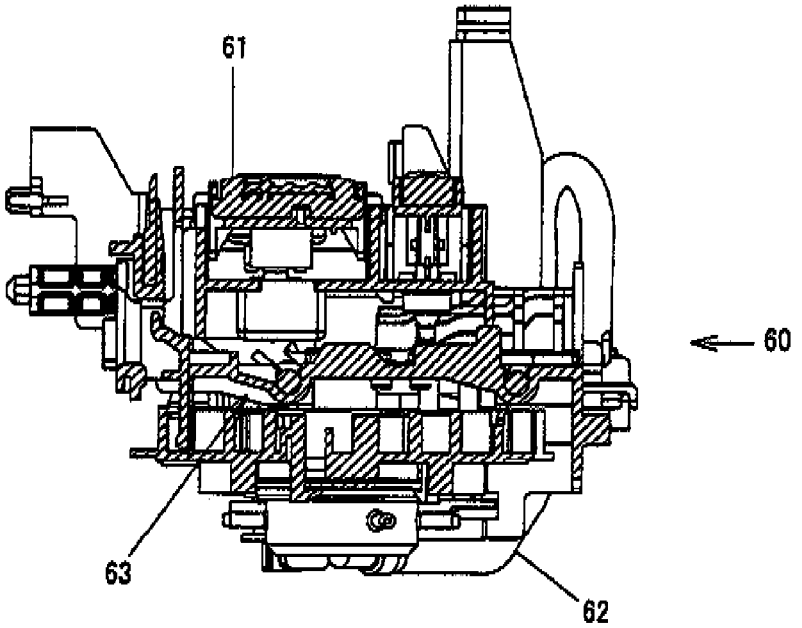

The maintenance mechanism 60 shown in FIGS. 3A and 3B includes a cap 61 and a supporter 62. The cap 61 is movable in the upward and downward direction 7 between (i) a contact position at which the cap 61 covers the ejection openings of the respective nozzles of the recording head 21 and (ii) a distant position at which the cap 61 is distant from the ejection openings. The supporter 62 supports the cap 61 such that the cap 61 is movable between the contact position and the distant position. The supporter 62 is provided with a lift-up mechanism 63 that moves the cap 61 when having received a drive power transmitted from the drive section 100 via the power transmission switching mechanism 40 which will be described below.

<Conveyance Device 30>

The conveyance device 30 shown in FIG. 2 includes: a first sheet-supply roller 31 rotatable to supply the sheet 5 placed on the upper tray 14; a second sheet-supply roller 32 rotatable to supply the sheet 5 placed on the lower tray 15; a main conveyance path 51 through which the sheet 5 supplied by the first sheet-supply roller 31 or the second sheet-supply roller 32 is conveyed; and an intermediate roller pair 54, a main conveyance-roller pair 55, and a sheet-discharge roller pair 56 provided on the main conveyance path 51 for nipping and conveying the sheet 5.

<First Sheet-Supply Roller 31 and Second Sheet-Supply Roller 32>

The first sheet-supply roller 31 is disposed on an upper side of the rear portion of the upper tray 14 and supported using an arm 34 and a rotation shaft 33 rotated by the drive section 100. The arm 34 has one end portion to which the first sheet-supply roller 31 is attached rotatably and the other end portion supported by the rotation shaft 33 such that the arm 34 is pivotable about the rotation shaft 33. The arm 34 includes transmission gears 35 for transmitting rotation of the rotation shaft 33 to the first sheet-supply roller 31. When the arm 34 is pivoted downward about the rotation shaft 33, the first sheet-supply roller 31 is brought into contact with an uppermost one of the sheets 5 placed on the upper tray 14. The rotation of the rotation shaft 33 is transmitted to the first sheet-supply roller 31 via the transmission gears 35, which rotates the first sheet-supply roller 31 to supply the uppermost sheet 5 upward from a rear wall of the upper tray 14.

Like the first sheet-supply roller 31, the second sheet-supply roller 32 is supported using a rotation shaft 36 and an arm 37 and rotatable to supply the sheet 5 placed on the lower tray 15.

<Main Conveyance Path 51>

The main conveyance path 51 is what is called a U-turn path defined by a guide member 53 and the platen 22 and including: a curved portion 51A having a curved shape in its cross section; and a straight portion 51B having a straight shape in its cross section and passing through a position between the platen 22 and the recording head 21. The main conveyance path 51 is defined such that one end thereof is located on an upper side of the rear wall of the upper tray 14, and the other end thereof is located on an upper side of the sheet-discharge tray 16. The sheet 5 supplied from the upper tray 14 or the lower tray 15 is conveyed frontward on the platen 22 and discharged onto the sheet-discharge tray 16.

<Intermediate Roller Pair 54>

The intermediate roller pair 54 includes: drive rollers 54B fixed to a rotation shaft 54A rotated by the drive section 100; and a driven roller 54C driven with the rotation of the drive rollers 54B. The intermediate roller pair 54 is disposed such that an axial direction of the rotation shaft 54A coincides with the rightward and leftward direction 9 and such that a nip position of the intermediate roller pair 54 is located in the curved portion 51A. The intermediate roller pair 54 nips and conveys the sheet 5 supplied from the upper tray 14 or the lower tray 15.

<Main Conveyance-Roller Pair 55>

The main conveyance-roller pair 55 (as one example of a conveyor) includes drive rollers 55B fixed to a rotation shaft 55A rotated by the drive section 100; and a driven roller 55C driven with the rotation of the drive rollers 55B. The main conveyance-roller pair 55 is disposed on a rear side of the platen 22 such that an axial direction of the rotation shaft 55A coincides with the rightward and leftward direction 9. The main conveyance-roller pair 55 conveys frontward the sheet 5 conveyed by the intermediate roller pair 54.

<Sheet-Discharge Roller Pair 56>

The sheet-discharge roller pair 56 (as one example of the conveyor) includes: drive rollers 56B fixed to a rotation shaft 56A rotated by the drive section 100; and a driven roller 56C driven with the rotation of the drive rollers 56B. The sheet-discharge roller pair 56 is disposed on a front side of the platen 22 such that an axial direction of the rotation shaft 56A coincides with the rightward and leftward direction 9. The sheet-discharge roller pair 56 discharges onto the sheet-discharge tray 16 the sheet 5 conveyed by the main conveyance-roller pair 55.

<Drive Section 100>

The drive section 100 includes a CR motor 101, an ASF motor 102, and an LF motor 103 shown in FIG. 9 and each as a drive motor rotatable forwardly and reversely (in forward and reverse directions). These motors 101, 102, 103 are driven or rotated by a drive circuit, not shown, and controlled by the control section 90.

<CR Motor 101>

A drive power of the CR motor 101 is transmitted to the carriage 23 by a first belt transmission mechanism, not shown, to move the carriage 23 in the rightward and leftward direction 9. For example, the first belt transmission mechanism includes an endless belt to which the carriage 23 is fixed, and when this belt is rotated by the CR motor 101, the carriage 23 is moved leftward or rightward. In the present embodiment, the forward rotation of the CR motor 101 (i.e., the rotation thereof in the forward direction) moves the carriage 23 leftward, and the reverse rotation of the CR motor 101 (i.e., the rotation thereof in the reverse direction) moves the carriage 23 rightward.

<ASF Motor 102>

A drive power of the ASF motor 102 (as one example of a drive source) is transmitted selectively to one of the first sheet-supply roller 31, the second sheet-supply roller 32, the intermediate roller pair 54, and the cap 61 by the power transmission switching mechanism 40.

<LF Motor 103>

A shaft of the LF motor 103 is connected to the rotation shaft 55A of the main conveyance-roller pair 55 directly or via a gear, so that the LF motor 103 can drive and rotate the rotation shaft 55A. A drive power of the LF motor 103 is transmitted to the rotation shaft 56A by a second belt transmission mechanism, not shown. The LF motor 103 and the second belt transmission mechanism rotates the main conveyance-roller pair 55 and the sheet-discharge roller pair 56 simultaneously in a direction for conveying the sheet 5 in a conveyance direction 38. In the present embodiment, the forward rotation of the LF motor 103 (i.e., the rotation thereof in the forward direction) moves the sheet 5 in the conveyance direction 38.

<Power Transmission Switching Mechanism 40>

Figure 4:
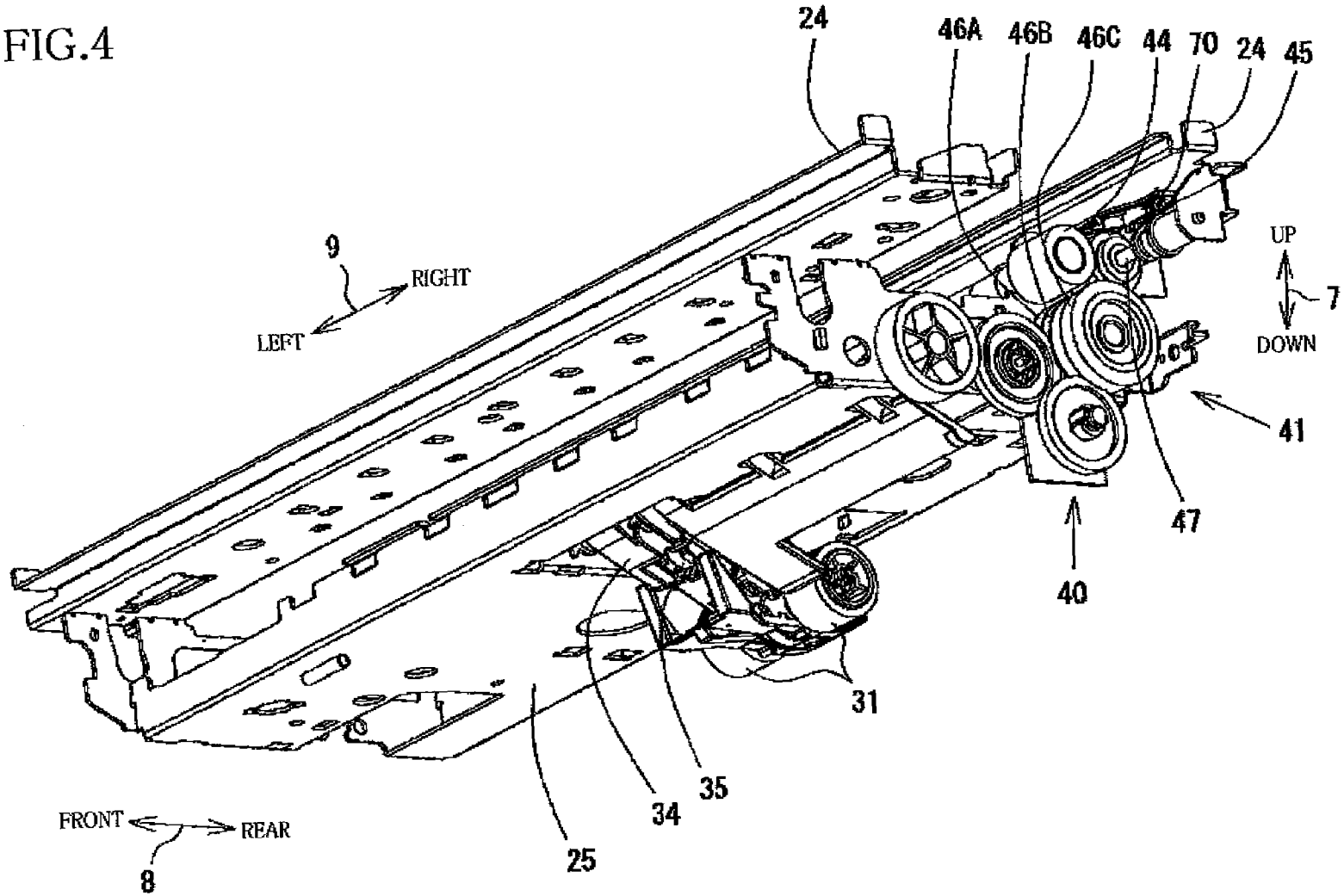
FIG. 4 is a perspective view showing a power transmission switching mechanism 40.

The power transmission switching mechanism 40 shown in FIG. 4 is disposed on a right side of the platen 22, that is, the power transmission switching mechanism 40 is disposed on a side of the platen 22 in a direction in which the carriage 23 is moved rightward. The power transmission switching mechanism 40 includes a gear change mechanism 41; a first transmitter 110 (see FIG. 8A) configured to transmit, to the first sheet-supply roller 31 or the intermediate roller pair 54, the drive power whose transmission has been determined or switched by the gear change mechanism 41; and a second transmitter 120 (see FIG. 8B) configured to transmit, to the second sheet-supply roller 32 or the intermediate roller pair 54, the drive power whose transmission has been determined or switched by the gear change mechanism 41.

<Gear Change Mechanism 41>

The gear change mechanism 41 includes: a drive gear 44 rotated by the rotation of the ASF motor 102 which is transmitted via a transmission gear 119 (see FIGS. 8A and 8B); a switching gear 45; a first receiving gear 46A, a second receiving gear 46B, and a third receiving gear 46C each having teeth meshable with the switching gear 45; and a holding mechanism 70 (see FIG. 5) for holding the switching gear 45.

<Drive Gear 44 and Switching Gear 45>

A support shaft 47 extending through the switching gear 45 is disposed so as to be generally parallel with a rotation shaft of the drive gear 44. The switching gear 45 is rotatable about the support shaft 47 and movable in an axial direction of the support shaft 47. The switching gear 45 has a width smaller than that of the drive gear 44 in the rightward and leftward direction 9. The switching gear 45 is movable in the rightward and leftward direction 9 within a range of the width of the drive gear 44 so as to change a posture of the switching gear 45 selectively to a first posture, a second posture, or a third posture. In each posture, the switching gear 45 meshes with the drive gear 44. The first posture is a posture in which the switching gear 45 meshes with a left end portion of the drive gear 44. The third posture is a posture in which the switching gear 45 meshes with a right end portion of the drive gear 44. When the switching gear 45 is moved rightward, the posture of the switching gear 45 changes to the first posture shown in FIG. 5, the second posture shown in FIG. 6A, and the third posture shown in FIG. 6B in order.

<Holding Mechanism 70>

As shown in FIGS. 5, 6A, 6B, and 7, the holding mechanism 70 includes: a lever member 71 and a contact member 72 through which the support shaft 47 extends; a holding member 73 for holding the lever member 71; and a first elastic member and a second elastic member, not shown.

Figure 7:
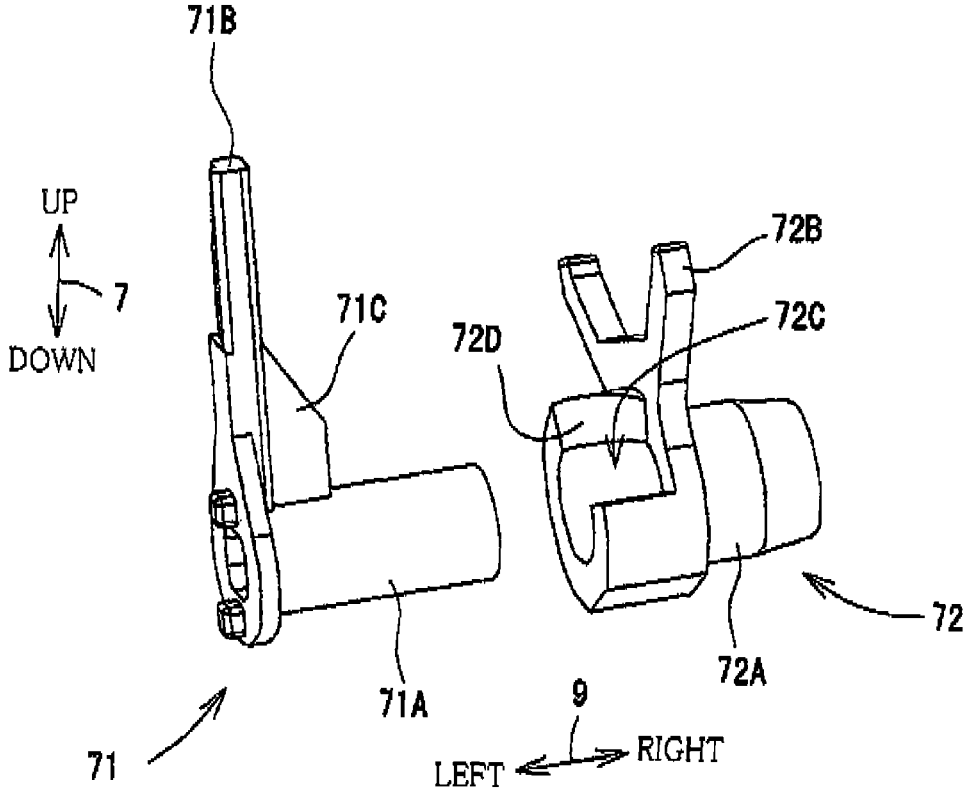
FIG. 7 is a perspective view showing a lever member 71 and a contact member 72.

As shown in FIG. 7, the lever member 71 includes: a circular cylindrical portion 71A through which the support shaft 47 extends; a lever projection 71B projecting from a left end portion of an outer circumferential face of the circular cylindrical portion 71A in its radial direction (in the upward direction in FIG. 7) and contactable with the contact piece 26 (see FIG. 5) provided on the carriage 23 from a left side of the contact piece 26; and a rib 71C projecting rightward from a lower end portion of a right face of the lever projection 71B. The lever member 71 is rotatable about the support shaft 47 and movable in the axial direction of the support shaft 47. The rib 71C is provided by a thin plate expanding in a circumferential direction of the circular cylindrical portion 71A. The lever member 71 is pressed rightward from a left side thereof by the switching gear 45 urged rightward by the second elastic member, not shown.

As shown in FIG. 7, the contact member 72 includes: a cylindrical portion 72A through which the support shaft 47 extends; and a braking piece 72B projecting from an outer circumferential face of the cylindrical portion 72A in its radial direction (in the upward direction in FIG. 7) and having a Y shape in which a distal end portion of the braking piece 72B is bifurcated into two parts. The braking piece 72B is rotatable about the support shaft 47 and movable in the axial direction of the support shaft 47. The cylindrical portion 72A has a cutout portion 72C at its left end portion, and a helical face 72D is provided by an outer circumferential face of the cutout portion 72C. The helical face 72D is coaxial with the cylindrical portion 72A, and a right end of the rib 71C of the lever member 71 is contactable with the helical face 72D. Accordingly, when the contact member 72 has been pressed onto the lever member 71 with a relatively large force, the lever member 71 is rotated. The contact member 72 is urged leftward by the first elastic member with a force that is larger than that of the second elastic member. The switching gear 45, the contact member 72, and the lever member 71 are pressed to one another by the first elastic member and the second elastic member and movable together with one another in the axial direction of the support shaft 47. For example, a coil spring is used as each of the first elastic member and the second elastic member.

Figure 5:
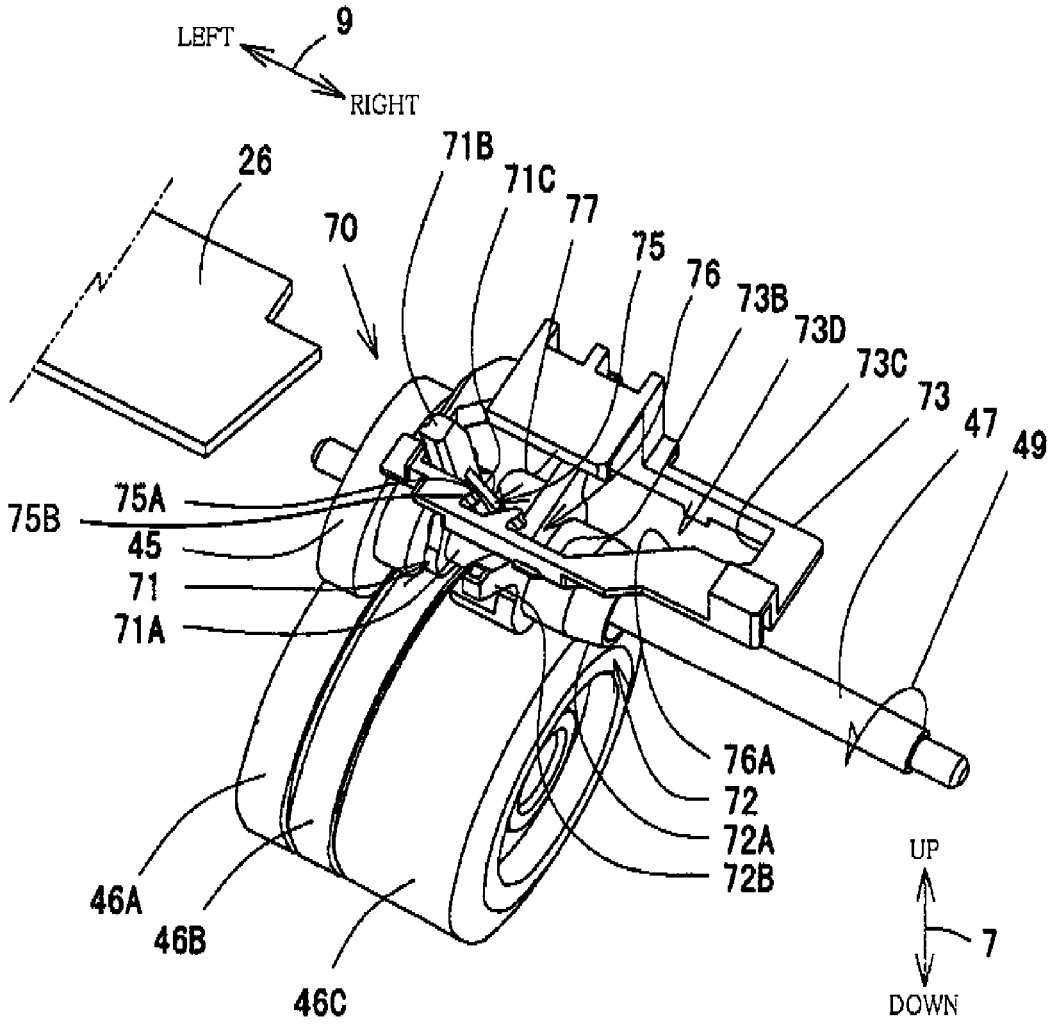
FIG. 5 is a perspective view showing a gear change mechanism 41 in which a switching gear 45 is in a first posture.
Figure 6A:
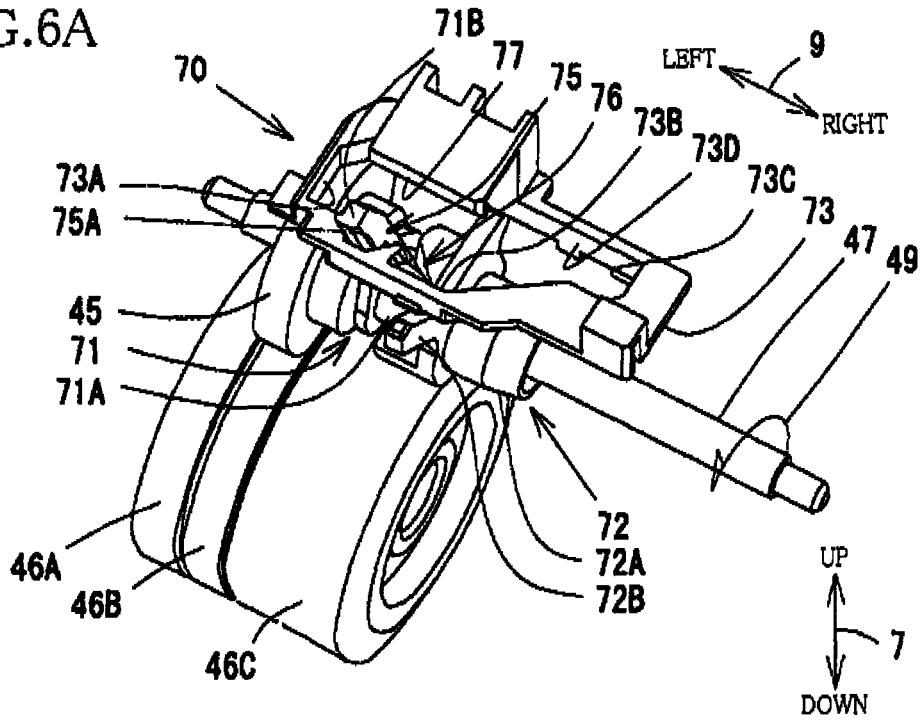
FIG. 6A is a perspective view showing the gear change mechanism 41 in which the switching gear 45 is in a second posture.
Figure 6B:
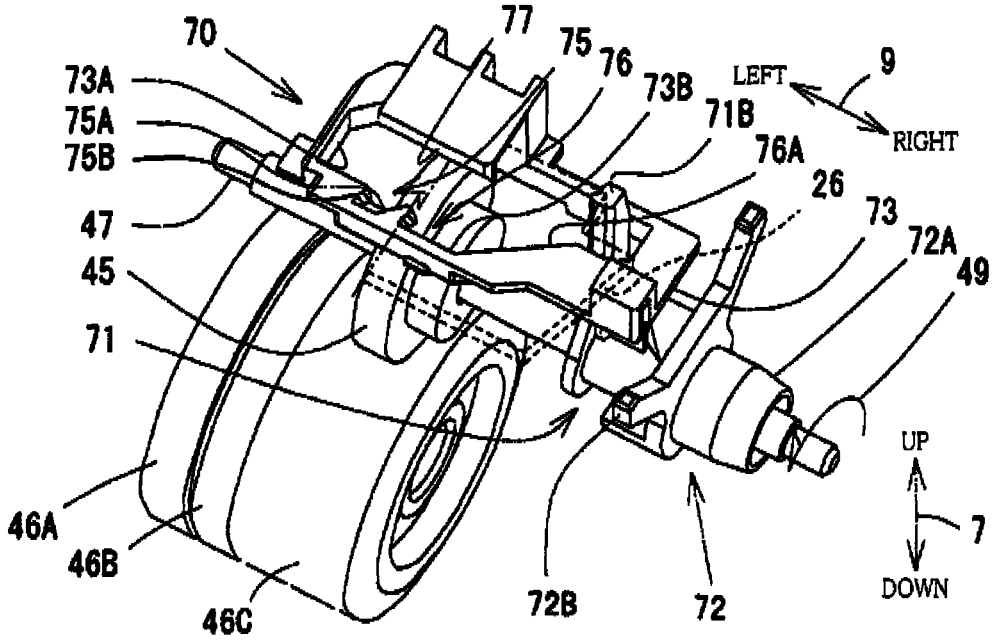
FIG. 6B is a perspective view showing the gear change mechanism 41 in which the switching gear 45 is in a third posture.

As shown in FIGS. 5 and 6A, 6B, the holding member 73 is provided by a frame elongated in the axial direction of the support shaft 47 (in the rightward and leftward direction 9). The holding member 73 is fixed to a frame, not shown. The lever projection 71B of the lever member 71 is inserted through an opening of the holding member 73 from a lower side thereof. A length of the holding member 73 in the rightward and leftward direction 9 is larger than the width of the drive gear 44, and the lever projection 71B is sufficiently smaller than the holding member 73. The lever projection 71B is movable in the opening of the holding member 73.

A distance between the two parts of the distal end portion of the Y-shaped braking piece 72B of the contact member 72 is longer than a width of the holding member 73. The holding member 73 is caught in the braking piece 72B in the state in which the switching gear 45 is in the first posture or the second posture. When the holding member 73 is caught in the braking piece 72B, the rotation of the contact member 72 about the support shaft 47 is limited. When the switching gear 45 is in the third posture, the braking piece 72B is not caught in the holding member 73. That is, when the switching gear 45 is in the third posture, the contact member 72 is rotatable about the support shaft 47.

When the contact piece 26 provided on the carriage 23 does not contact the lever projection 71B, the lever member 71 is urged leftward by the urging force of the first elastic member, whereby the lever projection 71B inserted through the opening of the holding member 73 is pressed onto a left inner face 73A of the holding member 73. When the lever projection 71B is held in contact with the left inner face 73A, the switching gear 45 is in the first posture. The contact member 72 pressed onto the lever member 71 by the urging force of the first elastic member urges the lever member 71 by using the helical face 72D in a direction 49 that is one of circumferential (rotational) directions of the support shaft 47, causing the lever projection 71B to be pressed onto a front inner circumferential face 73B of the holding member 73. The front inner circumferential face 73B has a first cutout 75 and a second cutout 76 formed therein.

When the lever projection 71B is pressed by the contact piece 26 in the first posture of the switching gear 45, the lever projection 71B is fitted in the first cutout 75. The state in which the lever projection 71B is fitted in the first cutout 75 is the second posture of the switching gear 45. After fitted in the first cutout 75, the lever projection 71B is held in contact with a left inner face 75B by the urging force of the first elastic member in the leftward direction. Thus, even when the contact piece 26 provided on the carriage 23 comes off the lever projection 71B, the second posture of the switching gear 45 is maintained. It is noted that the gear change mechanism 41 is one example of a switching portion. In other words, the lever projection 71B and the switching gear 45 are one example of the switching portion.

When the lever projection 71B fitted in the first cutout 75 is further pressed by the contact piece 26, the lever member 71 is slid and moved rightward on a first inclined face 75A of the first cutout 75 to be fitted in the second cutout 76. When the lever projection 71B fitted in the second cutout 76 is further pressed by the contact piece 26, the lever projection 71B is slid and moved on a second inclined face 76A to be brought into contact with a right inner face 73C of the holding member 73. The state in which the lever projection 71B is held in contact with, the right inner face 73C is the third posture of the switching gear 45.

That is, the state of the switching gear 45 when the lever projection 71B is held in contact with the left inner face 73A is the first posture. The state of the switching gear 45 when the lever projection 71B is fitted in the first cutout 75 is the second posture. The state of the switching gear 45 when the lever projection 71B is held in contact with the right inner face 73C is the third posture.

When the lever projection 71B is held in pressing contact with the right inner face 73C of the holding member 73, the carriage 23 is located at a position at which the ejection openings of the respective nozzles are located on an upper side of the cap 61 of the maintenance mechanism 60. That is, when the carriage 23 is located at its waiting position located at a right end portion of the guide rails 24, the switching gear 45 is in the third posture as a waiting posture.

The holding member 73 includes a limitation piece 77 for limiting the rotation of the lever projection 71B about the support shaft 47 when the carriage 23 located at the waiting position is moved leftward. When the carriage 23 located at the waiting position has been moved leftward and come off the lever projection 71B, the lever projection 71B is moved leftward on a rear inner face 73D of the holding member 73 by the urging force of the first elastic member and the limitation piece 77. The lever projection 71B then comes off the limitation piece 77 at a position near the left inner face 73A, and moves so as to be brought into contact with the left inner face 73A and the front inner circumferential face 73B.

It is noted that, when the posture of the switching gear 45 is returned from the second posture to the first posture, the carriage 23 is moved to the waiting position to bring the lever projection 71B into contact with the right inner face 73C, whereby the switching gear 45 temporarily takes the third posture. When the carriage 23 is then moved leftward, the lever projection 71B is moved leftward by the urging force of the first elastic member to be pressed onto the left inner face 73A. As thus described, when the posture of the switching gear 45 returns from the second posture to the first posture, the posture is temporarily changed to the third posture and then returned to the first posture.

In view of the above, the holding mechanism 70 holds the switching gear 45 when the switching gear 45 is in the first posture or the second posture changed from the first posture and does not hold the switching gear 45 when the switching gear 45 is in the third posture or the second posture changed from the third posture. Further, the holding mechanism 70 changes the posture of the switching gear 45 to the first posture, the second posture, or the third posture by the lever projection 71B pressed rightward by the contact piece 26 provided on the carriage 23. It is noted that the third posture of the switching gear 45 is kept by the carriage 23 maintaining the posture in which the lever projection 71B is held in contact with the right inner face 73C.

<First Receiving Gear 46A, Second Receiving Gear 46B, and Third Receiving Gear 46C>

As shown in FIGS. 5 and 6A, 6B, the first receiving gear 46A, the second receiving gear 46B, and the third receiving gear 46C have the same diameter as one another and are coaxial with one another. A rotation shaft of the gears 46A, 46B, and 46C extends in parallel with the axial direction of the support shaft 47. The first receiving gear 46A is disposed so as to be meshable with the switching gear 45 being in the first posture. The second receiving gear 46B is disposed so as to be meshable with the switching gear 45 being in the second posture. The third receiving gear 46C is disposed so as to be meshable with the switching gear 45 being in the third posture. The switching gear 45 is meshed with one of the first receiving gear 46A, the second receiving gear 46B, and the third receiving gear 46C for rotating the meshed one of the first receiving gear 46A, the second receiving gear 46B, and the third receiving gear 46C.

The first receiving gear 46A transmits the drive power generated by the forward rotation of the ASF motor 102 to the first sheet-supply roller 31 via the first transmitter 110 which will be described below, allowing the sheet supply of the first sheet-supply roller 31. The second receiving gear 46B transmits the drive power generated by the reverse rotation of the ASF motor 102 to the second sheet-supply roller 32 via the second transmitter 120 which will be described below, allowing the sheet supply of the second sheet-supply roller 32. The third receiving gear 46C transmits the drive power to the lift-up mechanism 63 of the maintenance mechanism 60 directly or via, e.g., a gear to move the cap 61 using the lift-up mechanism 63. That is, the forward or reverse rotation of the ASF motor 102 in the state in which the switching gear 45 is in the third posture changes a posture of the MFD 10 to a standby state in which the cap 61 covers the ejection openings of the nozzles or a recordable state in which the cap 61 does not cover the nozzles.

<First Transmitter 110>

Figure 8A:
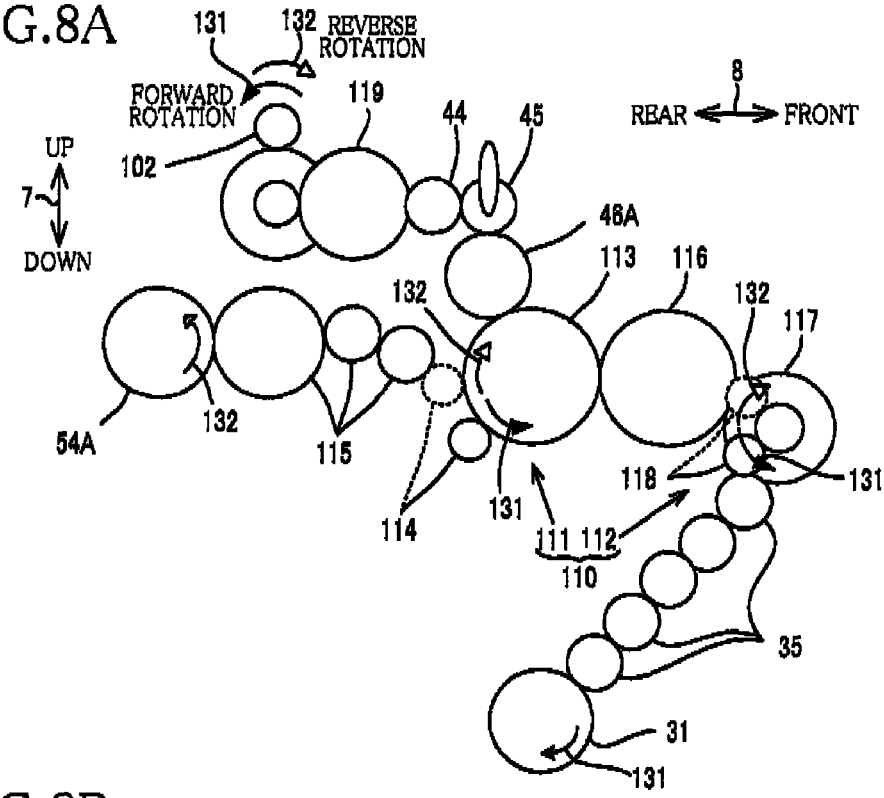
FIG. 8A is a cross-sectional view schematically showing a first transmitter 110.

As shown in FIG. 8A, the first transmitter 110 (as one example of a first drive-power transmitting mechanism) includes a first planetary-gear mechanism 111 and a second planetary-gear mechanism 112. The first planetary-gear mechanism 111 includes: a sun gear 113 meshable with the first receiving gear 46A; and a planetary gear 114 rotatable while revolving about the sun gear 113. When the ASF motor 102 is reversely rotated (in a direction indicated by arrow 132), the planetary gear 114 is meshed with one of transmission gears 115 for transmitting the rotation to the rotation shaft 54A of the intermediate roller pair 54 (see broken lines of the reference numeral 114). When the ASF motor 102 is forwardly rotated (in the direction indicated by the arrow 131), the planetary gear 114 is disengaged from the one of the transmission gears 115 for transmitting the rotation to the rotation shaft 54A of the intermediate roller pair 54 (see solid lines of the reference numeral 114).

The second planetary-gear mechanism 112 includes: a sun gear 117 to which the rotation of the sun gear 113 is transmitted via a transmission gear 116; and a planetary gear 118 rotatable while revolving about the sun gear 117. When the ASF motor 102 is forwardly rotated (in the direction indicated by the arrow 131), the planetary gear 118 is meshed with one of the transmission gears 35 for transmitting the rotation to the first sheet-supply roller 31 (see solid lines of the reference numeral 118). When the ASF motor 102 is reversely rotated (in the direction indicated by the arrow 132), the planetary gear 118 is disengaged from the one of the transmission gears 35 (see broken lines of the reference numeral 118).

In this construction, the first transmitter 110 transmits the drive power of the ASF motor 102 forwardly rotated (in the direction indicated by the arrow 131) to the first sheet-supply roller 31 and does not transmit the drive power to the intermediate roller pair 54. Further, the first transmitter 110 transmits the drive power of the ASF motor 102 reversely rotated (in the direction indicated by the arrow 132) to the intermediate roller pair 54 and does not transmit the drive power to the first sheet-supply roller 31.

<Second Transmitter 120>

Figure 8B:
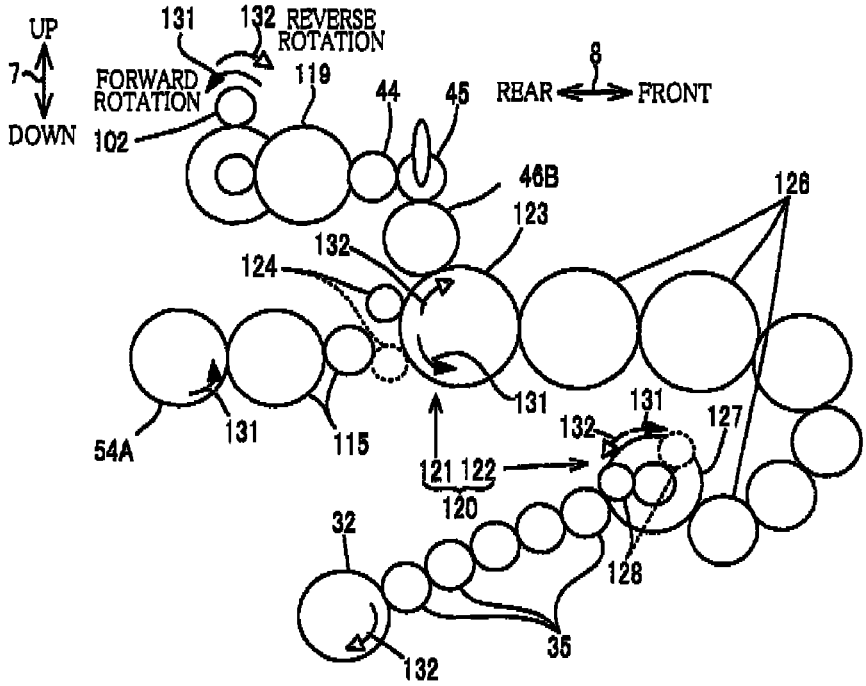
FIG. 8B is a cross-sectional view schematically showing a second transmitter 120.

As shown in FIG. 8B, the second transmitter 120 (as one example of a second drive-power transmitting mechanism) includes a third planetary-gear mechanism 121 and a fourth planetary-gear mechanism 122. The third planetary-gear mechanism 121 includes: a sun gear 123 meshable with the second receiving gear 46B; and a planetary gear 124 rotatable while revolving about the sun gear 123. When the ASF motor 102 is forwardly rotated (in a direction indicated by arrow 131), the planetary gear 124 is meshed with one of the transmission gears 115 for transmitting the rotation to the rotation shaft 54A of the intermediate roller pair 54 (see broken lines of the reference numeral 124). When the ASF motor 102 is reversely rotated (in the direction indicated by the arrow 132), the planetary gear 124 is disengaged from the one of the transmission gears 115 for transmitting the rotation to the rotation shaft 54A of the intermediate roller pair 54 (see solid lines of the reference numeral 124).

The fourth planetary-gear mechanism 122 includes: a sun gear 127 to which the rotation of the sun gear 123 is transmitted via transmission gears 126; and a planetary gear 128 rotatable while revolving about the sun gear 127. When the ASF motor 102 is reversely rotated (in the direction indicated by the arrow 132), the planetary gear 128 is meshed with one of the transmission gears 35 for transmitting the rotation to the second sheet-supply roller 32 (see solid lines of the reference numeral 128). When the ASF motor 102 is forwardly rotated (in the direction indicated by the arrow 131), the planetary gear 128 is disengaged from the one of the transmission gears 35 (see broken lines of the reference numeral 128).

In this construction, the second transmitter 120 transmits the drive power of the ASF motor 102 reversely rotated (in the direction indicated by the arrow 132) to the second sheet-supply roller 32 and does not transmit the drive power to the intermediate roller pair 54. Further, the second transmitter 120 transmits the drive power of the ASF motor 102 forwardly rotated (in the direction indicated by the arrow 131) to the intermediate roller pair 54 and does not transmit the drive power to the second sheet-supply roller 32.

Accordingly, when the sheet 5 accommodated on the upper tray 14 is supplied by the first sheet-supply roller 31, the ASF motor 102 is rotated forwardly in the sate in which the lever projection 71B is moved by the carriage 23 to establish the first posture. When the sheet 5 accommodated on the lower tray 15 is supplied by the second sheet-supply roller 32, the ASF motor 102 is rotated reversely in the state in which the lever projection 71B is moved by the carriage 23 to establish the second posture.

<Sensing Mechanism 80>

As shown in FIG. 9, the sensing mechanism 80 includes: an intermediate sensor 81 and a register sensor 82 shown in FIG. 2; and a linear encoder 83, a first rotary encoder (ASF rotary encoder) 84, and a second rotary encoder (LF rotary encoder) 85 shown in FIG. 9. The intermediate sensor 81 is disposed on an upstream side of the intermediate roller pair 54 in the conveyance direction 38 in the main conveyance path 51. The register sensor 82 is disposed on an upstream side of the main conveyance-roller pair 55 in the conveyance direction 38 in the main conveyance path 51.

Each of the intermediate sensor 81 and the register sensor 82 is provided by what is called a register sensor. Though a detailed explanation will not be given because a construction of the register sensor is well known, each of the sensors 81, 82 is constituted by a light-emitting diode, a photodiode, and a detector provided so as to be projected into or retracted from the main conveyance path 51, for example. An output of each of the sensors 81, 82 changes between a state in which the sheet 5 is passing through the sensor and a state in which the sheet 5 is not passing through the sensor.

Though a detailed explanation will not be given because a construction of the rotary encoder is well known, each of the ASF rotary encoder 84 and the LF rotary encoder 85 includes a light-emitting diode, a photodiode, and a disc mounted on the shaft or the rotation shaft of the drive motor, for example. The disc has (i) light transmitting portions through which light is transmitted and (ii) light intercepting portions each intercepting the light. When the disc is rotated, the light transmitting portions and the light intercepting portions alternately passes on a path of the light emitted from the light-emitting diode, which changes an output of the photodiode.

The ASF rotary encoder 84 is mounted on the ASF motor 102. The LF rotary encoder 85 is mounted on the LF motor 103. The ASF rotary encoder 84 and the LF rotary encoder 85 detect rotational amounts of the respective motors on which the encoders 84, 85 are respectively mounted, making it possible to sense a position of the sheet 5 for controlling the conveyance of the sheet 5, on the basis of a result of the output of the intermediate sensor 81 and the register sensor 82.

The linear encoder 83 is mounted on the guide rails 24 and includes an encoder strip, a light-emitting diode provided on the carriage 23, and a photodiode. The encoder strip has (i) light transmitting portions through which light is transmitted and (ii) light intercepting portions each intercepting the light. When the linear encoder 83 detects the movement of the carriage 23, the light-emitting diode mounted on the carriage 23 emits light to the encoder strip. When the light transmitting portions and the light intercepting portions alternately passes on a path of the light emitted from the light-emitting diode, an output of the photodiode changes, based on which the linear encoder 83 detects the position of the carriage 23.

<Control Section 90>

There will be next explained an electric configuration of the MFD 10 with reference to FIG. 9. The control section 90 controls overall operations of the MFD 10, but a detailed explanation for controlling the display 19, the scanning section, and the recording portion 20 is omitted.

The control section 90 is configured as a microcomputer mainly including: a CPU 91 for executing an arithmetic processing; a ROM 92 storing control programs and the like; a RAM 93 used as a data storage area or a data working area; an EEPROM 94 storing setting information and the like; and a timer counter 95 for measuring a time. In the present embodiment, the control section 90 executes main processings and power transmission switching processings (shown in FIGS. 10-12) which will be described below.

The CPU 91 controls the various functions of the MFD 10 and controls the components connected to the control section 90 in accordance with the programs and predetermined values stored in the ROM 92 and the RAM 93.

The ROM 92 stores the programs for controlling the various operations of the MFD 10. For example, the ROM 92 stores (i) various control programs including programs based on which the CPU 91 executes the processings shown in FIGS. 10-12 and (ii) data required for the execution of these control program.

The RAM 93 is used as the working area and the storage area for temporarily storing various data used when the CPU 91 executes the various programs. The RAM 93 includes a switch flag memory 93A storing a switch flag. The switch flag is set to ON when a power transmission switching operation or processing (which will be described below) has been required. The switch flag is set to OFF when the power transmission switching operation is not required.

The EEPROM 94 as one example of a storage portion stores settings, flags and the like to be kept also after a power source is turned off. The EEPROM 94 includes an upper-tray-sheet setting memory 94A and a lower-tray-sheet setting memory 94B. Each of the upper-tray-sheet setting memory 94A and the lower-tray-sheet setting memory 94B stores sheet setting information about a size of the sheet accommodated on a corresponding one of the upper tray 14 and the lower tray 15. The sheet setting information is set by the user.

The timer counter 95 is for measuring a length of time (elapsed time) of the forward and reverse rotations of the ASF motor 102. It is noted that, when the length of time of the forward and reverse rotations of the ASF motor 102 measured by the timer counter 95 has exceeded a predetermined length of time, the control section 90 stops the driving or rotation of the ASF motor 102.

<Power Transmission Switching Operation>

Figure 10:
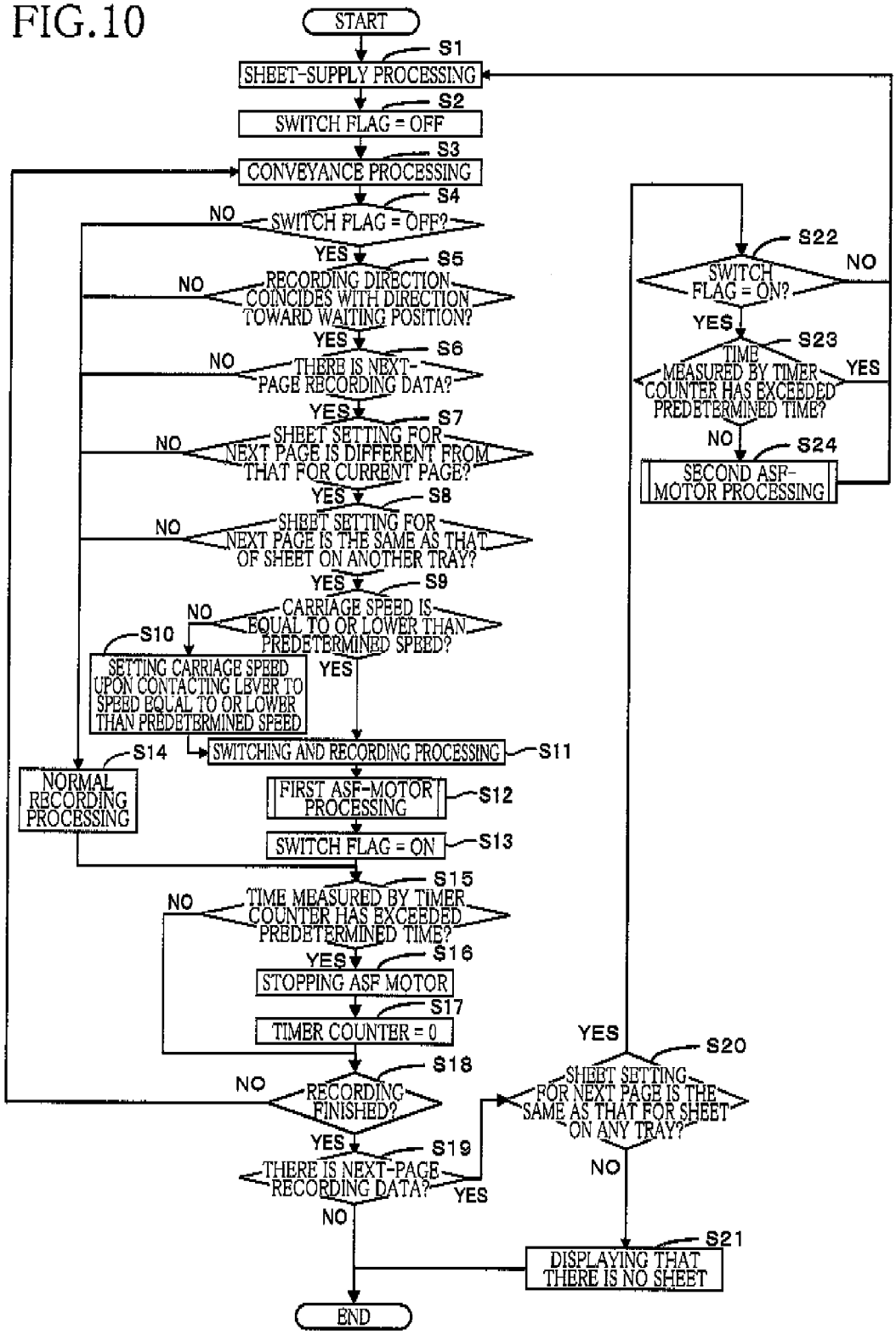
FIG. 10 is a flow-chart showing a main processing to be executed by the control section 90 in the first embodiment.
Figure 11A:
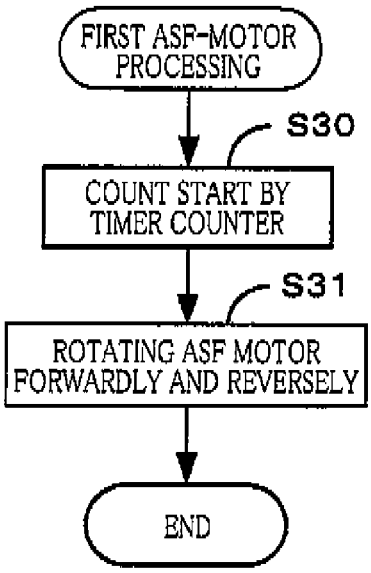
FIG. 11A is a view for explaining a first power transmission switching processing.
Figure 11B:
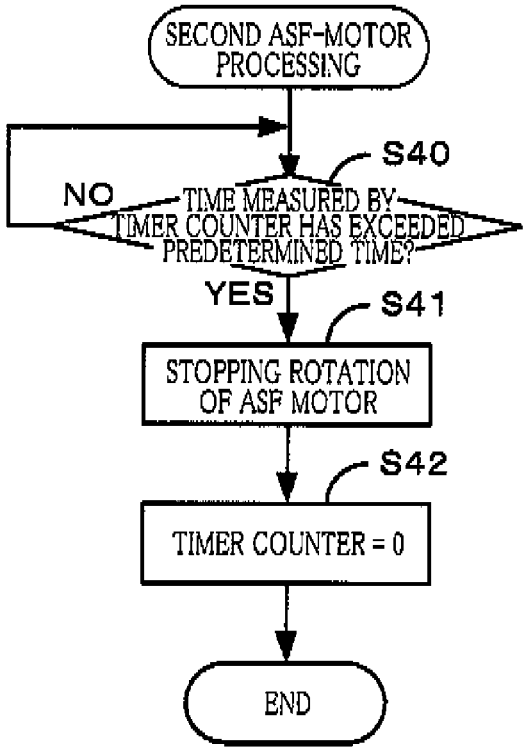
FIG. 11B is a view for explaining a second power transmission switching processing.
Figure 12:
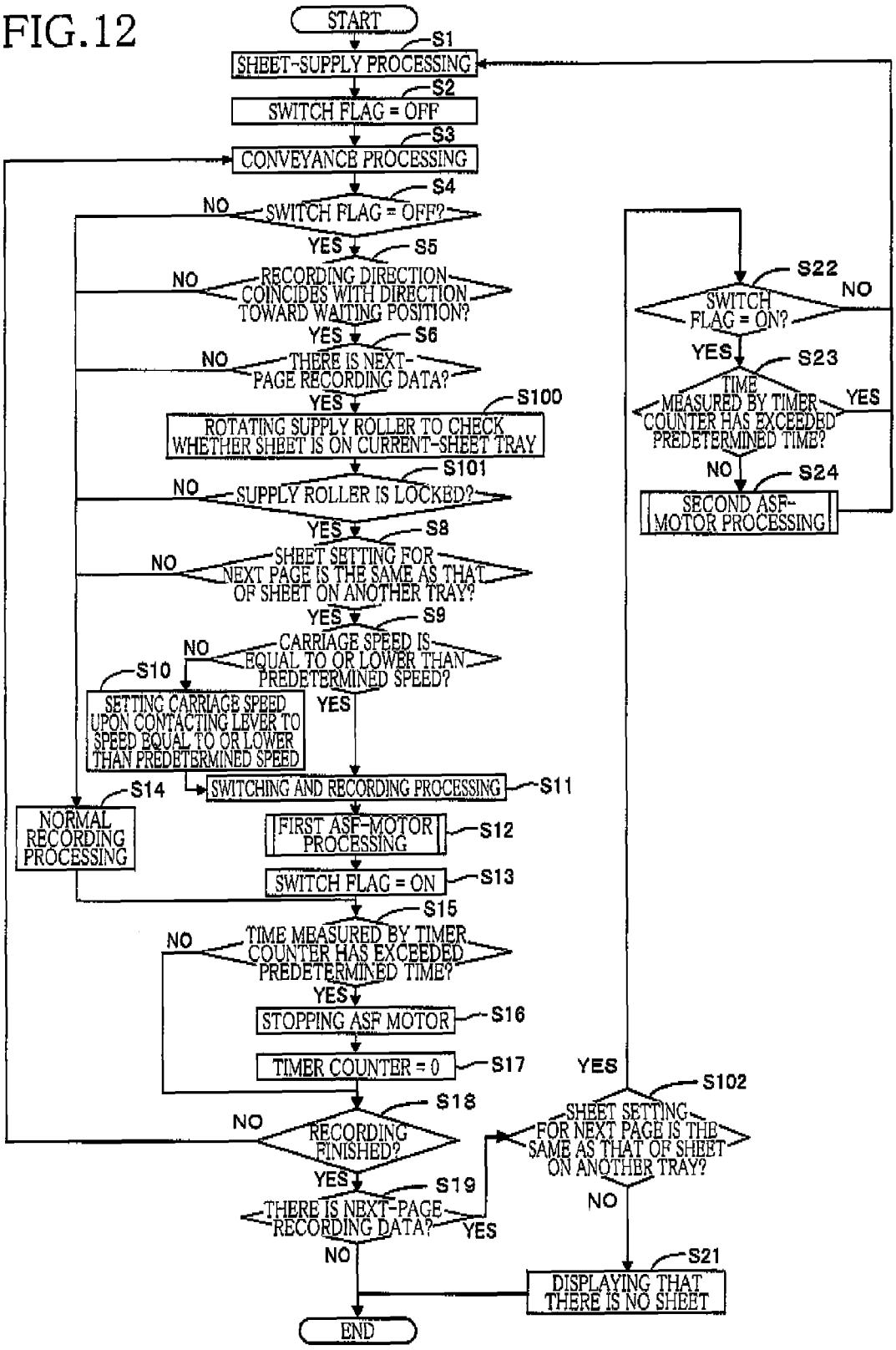
FIG. 12 is a flow-chart showing a main processing to be executed by the control section 90 in a second embodiment.

There will be next explained the power transmission switching operation of the MFD 10 as the present embodiment with reference to FIGS. 10-12. The power transmission switching operation is an operation for switching a target of the transmission of the drive power of the ASF motor 102 from the first sheet-supply roller 31 to the second sheet-supply roller 32 or from the second sheet-supply roller 32 to the first sheet-supply roller 31.

<Main Processing>

First, there will be explained the main processing executed by the control section 90 of the MFD 10 with reference to FIG. 10. The main processing includes the following processings for switching the power transmission. For example, when the control section 90 has judged, in or during the recording on the sheet 5 set on or supplied from the upper tray 14, that the next page is to be recorded on the sheet 5 accommodated in the lower tray 15, the control section 90, in the recording on the sheet 5 set on or supplied from the upper tray 14, controls the carriage 23, the recording head 21, and the main conveyance-roller pairs 55, 56 to move the carriage 23 to be brought into pressing contact with the lever projection 71B to change the posture of the switching gear 45 to the second posture, and then the control section 90, in the recording on the sheet 5 supplied from the upper tray 14, controls the carriage 23, the recording head 21, and the main conveyance-roller pairs 55, 56 to rotate the ASF motor 102 forwardly and reversely for the predetermined length of time.

In the present first embodiment, there will be explained, as one example, a case where a first page is recorded on an A4 size sheet 5A supplied from the upper tray 14, and then the next page is recorded on an A3 size sheet 5B supplied from the lower tray 15. In this case, the A4 size sheet and the A3 size sheet are respectively stored in the upper-tray-sheet setting memory 94A and the lower-tray-sheet setting memory 94B as the sheet setting information.

It should be noted that the first page may be recorded on the A3 size sheet 5B supplied from the lower tray 15, and then the next page may be recorded on the A4 size sheet 5A supplied from the upper tray 14.

<Recording on Sheet 5 Supplied from Upper Tray 14>

In S1, when the user has operated the external device (e.g., the PC) connected to the MFD 10 to command the MFD 10 to start image recording based on recording data for example, the control section 90 rotates the ASF motor 102 forwardly to rotate the first sheet-supply roller 31 for supplying the A4 size sheet 5A from the upper tray 14 (that is, the control section 90 executes a sheet-supply processing). Then in S2, the control section 90 sets the switch flag stored in the switch flag memory 93A to OFF. When the first sheet-supply roller 31 has been rotated by a predetermined amount by the rotation of the ASF motor 102 by a predetermined amount using the ASF rotary encoder 84, and then the A4 size sheet 5A supplied from the upper tray 14 has been nipped by the main conveyance-roller pair 55 (that is, when the sheet-supply processing is finished), the control section 90 in S3 starts a conveyance processing for conveying the sheet 5A for a predetermined distance (amount). It is noted that the predetermined distance for which the sheet 5 is supplied is determined depending upon various conditions such as a length of the recording head 21 in the frontward and rearward direction 8, a resolution, and a type of the sheet 5. After the conveyance processing, the control section 90 executes a recording processing for controlling the recording head 21 mounted on the carriage 23 to selectively eject the ink while the carriage 23 is being moved in a state in which the conveyed sheet is stopped. The image is recorded by repeating the conveyance processing and the recording processing predetermined times. It is noted that, as described above, the sheet-supply processing in S1 is finished before the execution of the conveyance processing in S3. That is, the control section 90 rotates the ASF motor 102 forwardly in S1 to start the sheet-supply processing and stops the rotation of the ASF motor 102 in S1 to finish the sheet-supply processing. The ASF motor 102 is kept stopped until the control section 90 executes an ASF motor processing (S12) which will be described below.

When the conveyance processing in S3 is finished, the control section 90 in S4 judges whether the switch flag stored in the switch flag memory 93A is OFF or not. Since the switch flag has been set to OFF in S2 (S4: YES), the control section 90 in S5 judges whether a recording direction in which the carriage 23 is to be moved in the next movement coincides with a direction directed toward the waiting position or not. Where the control section 90 has judged that the recording direction does not coincide with the direction directed toward the waiting position (S5: NO), the control section 90 in S14 executes a normal recording processing. The normal recording processing in S14 is a processing for performing the recording by moving the carriage 23 within a recording area based on the recording data.

When the normal recording processing in S14 is finished, the control section 90 in S15 judges whether the length of time measured by the timer counter 95 has exceeded the predetermined length of time or not (this judgment is one example of a second condition). Here, the measurement of the timer counter 95 is not started until a first ASF-motor processing in S12 which will be described below has been started. Thus, the control section 90 judges that the length of time measured by the timer counter 95 does not exceed the predetermined length of time (S15: NO), the control section 90 in S18 judges whether the recording for one page is finished or not. Here, the judgment of whether the recording for one page is finished or not is performed based on whether a trailing end of the A4 size sheet 5A for which the recording operation is being performed has come of or passed through the sheet-discharge roller pair 56, that is, the judgment is performed based on whether the sheet discharge of the sheet 5A is completed or not. Where the recording for one page is not finished (S18: NO), the control section 90 returns to S3 and executes the judgments in S4 and S5.

On the other hand, where the control section 90 has judged that the recording direction coincides with the direction directed toward the waiting position (S5: YES), the control section 90 in S6 judges whether there is next-page recording data or not. Since the recording is performed on the A4 size sheet 5A supplied from the upper tray 14, and then the recording for the next page is performed on the A3 size sheet 5B set on the lower tray 15 in the present embodiment, the control section 90 judges that there is data for recording on the next page (next-page recording data) (S6: YES). It is noted that, even where the control section 90 has judged that the recording direction coincides with the direction directed toward the waiting position (S5: YES), where the next page recording data has not been received in the recording on the A4 size sheet 5A supplied from the upper tray 14, the control section 90 judges that there is no next-page recording data (S6: NO) and executes the normal recording processing in S14.

Then in S7, the control section 90 judges whether a sheet setting for the next page is different from a sheet setting for the currently-recording page. Since the sheet setting for the next page (the A3 size sheet 5B) is different from the sheet setting for the currently-recording page (the A4 size sheet 5A) in the present embodiment (S7: YES), the control section 90 in S8 judges whether the sheet setting (size) for the next page is the same as the sheet setting (size) of the sheet 5 stacked on another (the other) tray or not. Here, the setting information of the sheet set on each tray is inputted by the user to the MFD 10, and the setting information of the sheet is stored in the upper-tray-sheet setting memory 94A and the lower-tray-sheet setting memory 94B of the EEPROM 94. In the present embodiment, the sheet setting for the next page (the A3 size sheet 5B) is the same as the sheet setting of the sheet set on the other tray (i.e., the sheet setting of the A3 size sheet which is stored in the lower-tray-sheet setting memory 94B) (S8: YES).

It is noted that, where the control section 90 has judged in S7 that the sheet setting for the next page is the same as the sheet setting for the currently-recording page (S7: NO) or where the control section 90 has judged in S8 that the sheet setting for the next page is different from the sheet setting of the sheet set on another tray (S8: NO), the control section 90 executes the normal recording processing in S14. The control section 90 then goes to S15 and S18 in which the control section 90 judges whether the recording for one page is finished or not. Where the control section 90 has judged that the recording for one page has not been finished (S18: NO), the control section 90 returns to S3 and executes required ones of the processings S3-S8, S14, S15, and S18. It is noted that the judgments in S5-S8 are one example of a first condition.

Where the control section 90 has judged in S8 that the sheet setting for the next page is the same as the sheet setting of the sheet set on another tray (S8: YES), the control section 90 in S9 judges whether a speed of the carriage 23 to be moved is equal to or lower than a predetermined speed or not. The speed of the carriage 23 is determined depending upon the recording data based on which the image is recorded, specifically, depending upon the type of the sheet and/or the resolution. For example, where the image is recorded on the plain paper sheet in a low resolution, the carriage 23 is moved at a high speed, and where the image is recorded on the glossy paper sheet in a high resolution, the carriage 23 is moved at a low speed. Where the control section 90 has judged that the speed of the carriage 23 to be moved is higher than the predetermined speed (S9: NO), the control section 90 in S10 sets a speed of the carriage 23 upon the contact thereof with the lever member 71 to a speed equal to or lower than the predetermined speed by increasing or enlarging a low speed area at which the carriage 23 is moved at a low speed. That is, the control section 90 executes a switching and recording processing in S11 in the state in which the speed of the carriage 23 is equal to or lower than the predetermined speed.

In the switching and recording processing in S11, the recording head 21 mounted on the carriage 23 being moved ejects ink droplets onto the stopped sheet 5, and the control section 90 extends a moving distance of the carriage 23 being moved toward the waiting position located outside (on a right side of) the recording area to press the contact piece 26 provided on the carriage 23 onto the lever projection 71B to move the lever projection 71B.

For example, an extension distance of the moving distance of the carriage 23 when the contact piece 26 is pressed onto the lever projection 71B is a distance from the right end of the recording area to a position at which the lever projection 71B is fitted in the first cutout 75 (that is, the switching gear 45 takes the second posture) because the sheet supply is switched from the supply from the upper tray 14 to the supply from the lower tray 15 in the present embodiment. Where the sheet supply is switched from the supply from the lower tray 15 to the supply from the upper tray 14, the posture of the switching gear 45 needs to be changed from the second posture to the third posture and then to the first posture. Thus, the extension distance of the moving distance of the carriage 23 is a distance from the right end of the recording area to a position at which the lever projection 71B is brought into contact with the right inner face 73C, that is, the switching gear 45 takes the third posture.

It is noted that the linear encoder 83 provides information about a current position and a target position of the carriage 23 when the carriage 23 is moved to press the lever projection 71B such that the switching gear 45 takes the first posture, the second posture, or the third posture.

After the switching and recording processing in S11, the control section 90 moves the carriage 23 to press the contact piece 26 onto the lever projection 71B such that the posture of the switching gear 45 takes the second posture that allows the sheet supply from the lower tray 15 by the second sheet-supply roller 32. The control section 90 then goes to S12 to execute the first ASF-motor processing which will be described below. After the first ASF-motor processing in S12, the control section 90 in S13 sets the switch flag of the switch flag memory 93A to ON.

Then in S15, the control section 90 judges whether the length of time measured by the timer counter 95 in the first ASF-motor processing (S12) has exceeded the predetermined length of time or not. Where the control section 90 has judged that the length of time measured by the timer counter 95 has exceeded the predetermined length of time (S15: YES), the power transmission switching operation is completed. Thus, the control section 90 in S16 stops the ASF motor 102 and in S17 zeros the timer counter 95. On the other hand, where the control section 90 has judged that the length of time measured by the timer counter 95 has not exceeded the predetermined length of time (S15: NO), the power transmission switching operation has not been completed. Thus, the control section 90 continues the first ASF-motor processing in S15 and does not execute the processings in S16 and S17. Then in S18, the control section 90 judges whether the recording for one page is finished or not. Where the control section 90 has judged that the recording for one page has not been finished (S18: NO), the control section 90 returns to S3.

Where the control section 90 has executed the first ASF-motor processing in S12 and then returned to S3 to execute the conveyance processing, the switch flag of the switch flag memory 93A is ON (S4: NO). Thus, the control section 90 executes the normal recording processing in S14 and executes required ones of the processings S3, S4, S14, and S15-S18 until the recording for one page is finished (S18: YES).

When the sheet discharge of the A4 size sheet 5A is completed, and the recording for one page is completed (S18: YES), the control section 90 in S19 judges whether there is next-page recording data or not. In the present embodiment, since there is the recording data, as the next-page recording data, for recording the image on the A3 size sheet 5B after the recording on the A4 size sheet 5A, the control section 90 judges that there is the next-page recording data (S19: YES). Then in S20, the control section 90 judges whether the sheet setting for the next page is the same as the sheet setting for the sheet accommodated in any of the trays or not. In the present embodiment, since the sheet setting for the A3 size sheet 5B on which the recording for the next page is to be performed is the same as the sheet setting of the A3 size sheet which is stored in the lower-tray-sheet setting memory 94B (S20: YES), the control section 90 goes to S22.

It is noted that, where the sheet 5 different from the A3 size sheet 5B is set on the lower tray 15 or where the size of the sheet 5 to be recorded for the next page is not stored in any of the upper-tray-sheet setting memory 94A and the lower-tray-sheet setting memory 94B (S20: NO), for example, the control section 90 in S21 controls the display 19 to display thereon a message indicating that there is no appropriate-size sheet for recording the next page, for example, and the recording is finished. As a result, the main processing is finished.

Where the affirmative decision has been made in S20 (S20: YES), the switch flag of the switch flag memory 93A is set to ON in S13 in the recording on the A4 size sheet 5A supplied from the upper tray 14 in the present embodiment (S22: YES). Then, in S23, the control section 90 judges whether or not the length of time measured by the timer counter 95 has exceeded the predetermined length of time in the recording on the A4 size sheet 5A. That is, the control section 90 in S23 judges whether or not the power transmission switching operation for switching the transmission of the drive power of the ASF motor 102 from the first sheet-supply roller 31 to the second sheet-supply roller 32 has not been completed. It is noted that, a case where the switch flag is OFF in S22 (S22: NO) is a case where the recording for the next page is to be performed on the sheet set on the upper tray 14 after the recording on the sheet set on the upper tray 14 is completed, for example.

The judgment in S23 is performed on the basis of the result of the judgment in S15. For example, where the length of time measured by the timer counter 95 has exceeded the predetermined length of time, the control section 90 judges that the power transmission switching operation has been completed (S23: YES). On the other hand, where the length of time measured by the timer counter 95 has not exceeded the predetermined length of time, the control section 90 judges that the power transmission switching operation has not been completed (S23: NO), and the control section 90 goes to S24 to execute a second ASF-motor processing which will be described below. Where the control section 90 has judged that the power transmission switching operation has been completed (S23: YES), or where the second ASF-motor processing (S24) is completed, the control section 90 returns to S1.

<Recording on Sheet 5 Supplied from Lower Tray 15>

As described above, when the power transmission switching operation for switching a target of the transmission of the drive power of the ASF motor 102 from the first sheet-supply roller 31 to the second sheet-supply roller 32 (S12-S17 or S24) is completed, the control section 90 in S1 starts the sheet-supply processing for supplying the A3 size sheet 5B set on the lower tray 15 by rotating the ASF motor 102 reversely to rotate the second sheet-supply roller 32. When the sheet-supply processing in S1 for supplying the A3 size sheet 5B set on the lower tray 15 is completed, the control section 90 in S2 sets the switch flag (stored in the switch flag memory 93A in the ON state) to OFF and in S3 executes the conveyance processing.

In the present embodiment, since the recording is not performed after the recording on the A3 size sheet 5B, the control section 90 judges that the switch flag stored in the switch flag memory 93A is OFF (S4: YES), and the recording direction coincides with the direction directed toward the waiting position (S5: YES), but there is no next-page recording data (S6: NO). Thus, as in the case where the recording direction does not coincide with the direction directed toward the waiting position (S5: NO), the control section 90 executes only the normal recording processing in S14.

In the present embodiment, since the first ASF-motor processing in S12 is not performed after the recording on the A3 size sheet 5B, the timer counter 95 is zero (S15: NO). Thus, the control section 90 executes required ones of the processings S3-S6, S14, S15, and S18 until the recording for one page is completed (S18: YES). When the recording for one page is completed, that is, when the recording on the A3 size sheet 5B based on the recording data is completed (S18: YES), the control section 90 judges that there is no next-page recording data (S19: NO), and the recording based on the recording data is finished. As a result, the main processing is finished.

<ASF-Motor Processing>

There will be next explained the first ASF-motor processing (see FIG. 11A) in S12 in FIG. 10 and the second ASF-motor processing (see FIG. 11B) in S24 in FIG. 10.

When the first ASF-motor processing has been started in S12, the control section 90 in S30 controls the timer counter 95 to start to measure the time of the driving of the ASF motor 102. Then in S31, the control section 90 finishes the first ASF-motor processing in a state in which the ASF motor 102 is rotating forwardly and reversely. It is noted that the forward and reverse rotation of the ASF motor 102 in S12 is performed for facilitating the mesh of the switching gear 45 with the first receiving gear 46A or the second receiving gear 46B.

The control section 90 executes the second ASF-motor processing where the length of time of the forward and reverse rotation of the ASF motor 102 measured by the timer counter 95 and started in the first ASF-motor processing does not exceed the predetermined length of time in the recording on the A4 size sheet in the present embodiment, that is, where the power transmission switching operation has not been completed in the recording on the A4 size sheet. The second ASF-motor processing is a processing for completing the power transmission switching operation before the next sheet or the A3 size sheet set on the lower tray 15 is supplied. When the second ASF-motor processing has been started in S24, the control section 90 in S40 judges whether the length of time measured by the timer counter 95 has exceeded the predetermined length of time or not. The judgment is repeated until the length of time measured by the timer counter 95 has exceeded the predetermined length of time (S40: YES). Thus, the forward and reverse rotation of the ASF motor 102 in S31 in the first ASF-motor processing is repeated until the control section 90 in S40 judges that the length of time measured by the timer counter 95 has exceeded the predetermined length of time. When the control section 90 has judged that the length of time measured by the timer counter 95 has exceeded the predetermined length, of time (S40: YES), the control section 90 in S41 stops the driving or rotation of the ASF motor 102. Then in S42, the control section 90 then zeros the timer counter 95, and the second ASF-motor processing is finished.

<Second Embodiment>

There will be next explained, with reference to FIG. 12, a case where the A4 size sheet is set on each of the upper tray 14 and the lower tray 15, and when the sheet 5A set on the upper tray 14 has run out (in other words, the upper tray 14 has become empty) in the recording, the sheet supply is switched from the supply from the upper tray 14 to the supply from the lower tray 15, for example. In this embodiment, the A4 size sheet is stored in each of the upper-tray-sheet setting memory 94A and the lower-tray-sheet setting memory 94B as the sheet setting information.

It should be noted that when the sheet 5B set on the lower tray 15 has run out in the recording, the sheet supply may be switched from the supply from the lower tray 15 to the supply from the upper tray 14. It is noted that the same numerals as used in FIG. 10 are used to designate the corresponding processings of this second embodiment, and an explanation of which is dispensed with.

In the main processing, the control section 90 executes the processings S1-S5 and then judges in S6 that there is next-page recording data (S6: YES). Then in S100, the control section 90 checks and judges whether there is any sheet 5 on the tray on which the sheet 5 being currently recorded has been set. In the present embodiment, in order to check whether there is any A4 size sheet 5A on the upper tray 14 or not, the control section 90 starts to rotate the first sheet-supply roller 31 that is for supplying the sheet 5A set on the upper tray 14. Then in S101, the control section 90 checks or judges whether the sheet-supply roller 31 has been locked or not.

In the present embodiment, when the sheet 5A set on the upper tray 14 has run out, the first sheet-supply roller 31 is brought into contact with a bottom face of the upper tray 14, and then locked (that is, the rotation of the first sheet-supply roller 31 is locked). Where there is the sheet 5A on the upper tray 14, the first sheet-supply roller 31 is rotated because the contacted sheet is moved. Thus, the first sheet-supply roller 31 is not locked. It is noted that the control section 90 judges that the first sheet-supply roller 31 has been locked, where the disc of the ASF rotary encoder 84 is not rotated even when the ASF motor 102 has driven and rotated for the predetermined length of time, that is, where the light transmitting portions and the light intercepting portions of the disc do not alternately passes through the light path of the light-emitting diode, and thus the control section 90 has judged that the output of the photodiode is not changed. Further, the control section 90 may judge that the first sheet-supply roller 31 has been locked, where a current value upon driving the ASF motor 102 has exceeded a certain upper limit value. Where the control section 90 has judged that the first sheet-supply roller 31 is not locked (S101: NO), the sheet exists on the upper tray 14. Thus, the normal recording processing is executed in S14.

Where the control section 90 has judged that the first sheet-supply roller 31 has been locked (S101: YES), the control section judges that there is no A4 size sheet 5 on the upper tray 14. Then in S8, the control section 90 judges whether the sheet setting for the next page is the same as the sheet setting (size) of the sheet 5 stacked on another tray or not. In the present embodiment, the sheet setting for the next page (i.e., the A4 size sheet 5) is the same as the sheet setting of the sheet set on another tray (i.e., the sheet setting of the A4 size sheet which is stored in the lower-tray-sheet setting memory 94B) (S8: YES). The control section 90 then executes required ones of the above-explained processings S9-S18 to start the power transmission switching operation.

When the recording for one page is completed, that is, when the recording on the A4 size sheet 5A supplied from the upper tray 14 is completed (S18: YES), the control section 90 judges that there is the next-page recording data in the present embodiment (S19: YES). Then in S102, the control section 90 judges whether the sheet setting for the next page is the same as the sheet setting (size) of the sheet 5 stacked on another tray or not. In the present embodiment, since the sheet setting for the next page (i.e., the A4 size sheet 5) is the same as the sheet setting of the sheet set on the other tray (i.e., the sheet setting of the A4 size sheet which is stored in the lower-tray-sheet setting memory 94B) (S102: YES), the control section 90 goes to S22. Since the switch flag is set to ON in S13 (S22: YES), the control section 90 goes to S23.

The control section 90 then returns to S1 where the control section 90 has judged that the length of time measured by the timer counter 95 has exceeded the predetermined length of time (S23: YES) or where the control section 90 has judged that the length of time measured by the timer counter 95 has not exceeded the predetermined length of time, that is the power transmission switching has not been completed (S23: NO), and the power transmission switching operation has been completed by the second ASF-motor processing in S24.

When the power transmission switching operation for switching the transmission of the drive power of the ASF motor 102 from the first sheet-supply roller 31 to the second sheet-supply roller 32 is completed, the control section 90 in S1 rotates the ASF motor 102 reversely to rotate the second sheet-supply roller 32 to start the sheet-supply processing for the A4 size sheet 5B set on the lower tray 15. When the sheet-supply processing for the A4 size sheet 5B set on the lower tray 15 is completed, the control section 90 in S2 sets the switch flag (stored in the switch flag memory 93A in the ON state) to OFF.

Since there is no next-page recording data, the control section 90 then executes required ones of the processings S3-S6 and S14-S18. When the recording for one page is completed, that is, when the recording on the A4 size sheet 5B supplied from the lower tray 15 is completed (S18: YES), the control section 90 judges that there is not the next page (S19: NO) and completes the recording based on the recording data, and the main processing is completed.

As described above, where the recording for a plurality of pages including different sheet sizes, when the sheet supply is switched from the supply from the sheet-supply tray on which the sheet being recorded has been stacked to the supply from the sheet-supply tray on which the sheet for the next page is stacked, the power transmission switching operation is performed in the current recording for one page on the sheet. Specifically, in the current recording for the one page, the power transmission switching operation is performed by forwardly and reversely rotating the ASF motor 102 that is not used for the current image recording processing. Thus, even in the case of the recording in which the sheet size is changed in the recording, a time for the power transmission switching operation is not required, making it possible to shorten a time from the current recording to the recording for the next page.

Further, where the sheet having the same size is set on each sheet-supply tray, when the sheet-supply tray on which the sheet being recorded had been set has become empty, and when the sheet supply is switched from the supply from the sheet-supply tray on which the sheet being recorded had been set to the supply from the sheet-supply tray on which the sheet for the next page is set, the power transmission switching operation is performed in the current recording for one page on the sheet. Specifically, in the current recording for the one page, the power transmission switching operation is performed by forwardly and reversely rotating the ASF motor 102 that is not used for the current image recording processing. Thus, even where the sheet has run out in the recording, the time for the power transmission switching operation is not required, making it possible to shorten the time from the current recording to the recording for the next page.

In the above-described embodiments, the control section 90 sets the moving (recording) speed of the carriage 23 to the speed equal to or lower than the predetermined speed in S10 in FIGS. 10 and 12. For example, when the carriage 23 is brought into contact with the lever projection 71B at a high speed in high-speed recording in which the image is recorded on the plain paper sheet in a low resolution as described above, the carriage 23 may not be stopped accurately, making it impossible to move the lever projection 71B and the switching gear 45 to their respective appropriate positions. However, in the above-described embodiments, since the moving speed of the carriage 23 is set to the low speed, it is possible to solve this problem. As thus described, where the moving speed of the carriage 23 upon contacting the lever projection 71B is set to be equal to or lower than the predetermined speed, the stopping accuracy upon the pressing contact of the carriage 23 with the lever projection 71B can be improved. Thus, the lever projection 71B and the switching gear 45 can be moved to their respective appropriate positions for appropriate power transmission switching operation. Further, in the above-described embodiments, the moving speed of the carriage 23 is reduced by enlarging the low speed area but the carriage 23 may be stopped before contacting the lever projection 71B, and then brough into contact with the lever projection 71B at the speed equal to or lower than the predetermined speed.

In the above-described embodiments, the control section 90 extends the moving distance of the carriage 23 to move the lever projection 71B. This does not need a time for moving the carriage 23 only for the power transmission switching operation, making it possible to shorten the time to the recording for the next page. However, instead of this configuration, the carriage 23 may be moved to be brought into pressing contact with the lever projection 71B in the conveyance processing or in a standby time (or a waiting time) for drying the ink in a case where a large amount of the ink has been ejected on the sheet, for example. That is, the carriage 23 may be moved at any timing as long as the carriage 23 is moved in the image recording processing for one page.

In the present embodiment, where there is no appropriate-size sheet for recording the next page, the control section 90 in S21 controls the display 19 to display thereon the message indicating that there is no appropriate-size sheet for recording the next page. Thus, it is possible to notify that the user should set the appropriate-size sheet on the appropriate sheet-supply tray.

In the above-described embodiments, the user sets the sheet setting of the sheet stacked on the sheet-supply tray. However, a sheet size sensor may be provided on the sheet-supply tray to set the sheet setting of the sheet stacked on the sheet-supply tray.

In the above-described embodiments, the upper tray 14 and the lower tray 15 on which the sheet(s) is set are stacked on each other, but more than two trays may be stacked on one another where the power transmission switching operation therefor is required upon the sheet supply from the sheet-supply trays. Further, a manual tray may be used as one of the sheet-supply trays.

In the above-described embodiments, the control section 90 judges whether the power transmission switching operation is completed or not on the basis of the time measured by the timer counter 95. However, the number of the forward and/or reverse rotation of the ASF motor 102 may be measured for the judgment, for example. That is, the MFD 10 may further include a rotation-number couter (as one example of a rotation-number measuring portion) configured to measure the number of the forward and/or reverse rotation of the ASF motor 102. In this configuration, the control section 90 judges that the power transmission switching operation is completed, where the number of the forward and/or reverse rotation of the ASF motor 102 which has been measured by the rotation-number couter has exceeded (or has become equal to or greater than) a predetermined number (this judgment is as one example of the second condition).

In the above-described embodiments, a sheet orientation upon the sheet setting of the sheet set on the tray is not considered. However, the sheet orientation may be considered such that an orientation in which a lengthwise direction of the sheet coincides with the frontward and rearward direction 8 is a vertical (portrait) orientation, and an orientation in which a widthwise direction of the sheet coincides with the frontward and rearward direction 8 is a horizontal (landscape) orientation, for example.

In the above-described embodiments, the check of whether the sheet exists on the upper tray 14 or not is performed based on the judgment of whether the first sheet-supply roller 31 has been locked or not. However, a sheet sensor for detecting the presence or absence of the sheet may be attached on the upper tray 14, and the control section 90 may judge whether the sheet exists on the upper tray 14 or not on the basis of a detection signal outputted from the sheet sensor, for example.

It is noted that, in the above-described embodiments, in the case of the recording on the plurality of the sheets, the control section 90 judges whether the power transmission switching operation for the ASF motor 102 is required or not, and the MFD 10 performs the power transmission switching operation for the ASF motor 102 in the recording. However, when the MFD 10 performs the recording on a single sheet, the MFD 10 may perform the power transmission switching operation for the ASF motor 102 in the recording. For example, there is a case where sheets used for image recording on a single sheet (e.g., recording an invoice or a bill including a company name to be printed thereon) are stacked on the upper tray 14 while usually used sheets are stacked on the lower tray 15, and the sheet is supplied from the upper tray 14 for the recording on only one sheet. In such a case, the MFD 10 drives the ASF motor 102 to supply the sheet from the upper tray 14 for the recording on the conveyed sheet, but even where the number of the sheet to be printed is one, the power transmission switching operation is started in the recording on the sheet supplied from the upper tray 14, such that the sheet on the lower tray 15 can be supplied after the recording. For example, where the lower tray 15 is selected as a usually used tray by a default setting or a user setting and where the MFD 10 has received a command for recording the sheet on the upper tray 14, the case is realized by performing the power transmission switching operation for the ASF motor 102. It is noted that instead of the above-mentioned configuration, the MFD 1 may be configured such that the sheet for recording on the single sheet is supplied from the manual tray, and the power transmission switching operation for the ASF motor 102 is started in the recording on the sheet supplied from the manual tray, and, after the recording, a state in which the sheet is to be supplied from a tray other than the manual tray is established.

In the above-described embodiments, the power transmission switching operation and the forward and reverse rotation of the ASF motor 102 are completed in the recording on one sheet 5. However, as long as the power transmission switching operation is started in the recording on the one sheet 5, the power transmission switching operation and/or the forward and reverse rotation of the ASF motor 102 does not need to be completed in the recording on the one sheet 5. Also in this configuration, it is possible to shorten a time from the end of the recording on the one sheet 5 to the start of the recording on the next sheet 5.

In view of the above, the control section 90 can be considered to include an image-recording processing section considered to execute the processing in S14, for example. Further, the control section 90 can be considered to include a switching processing section configured to execute the processing in S11, for example. Further, the control section 90 can be considered to include a forward-and-reverse-rotation processing section configured to execute the processing in S12, for example. Further, the control section 90 can be considered to include a switching-processing-requirement judging section considered to execute the processings in S5-S8, for example. Further, the control section 90 can be considered to include a switching-processing-execution judging section considered to execute the processing in S4, for example. Further, the control section 90 can be considered to include a condition judging section considered to execute the processings in S7 and S8, for example. Further, the control section 90 can be considered to include a moving direction judging section considered to execute the processing in S5, for example. Further, the control section 90 can be considered to include a speed judging section considered to execute the processing in S9, for example. Further, the control section 90 can be considered to include a presence judging section considered to execute the processing in S100 and S101, for example.

What is claimed is:

1. An image recording apparatus, comprising:

a first sheet-supply tray and a second sheet-supply tray on each of which a recording medium is to be placed;

a first sheet-supply roller rotatable to supply the recording medium to be placed on the first sheet-supply tray;

a second sheet-supply roller rotatable to supply the recording medium to be placed on the second sheet-supply tray;

a conveyor configured to convey the recording medium supplied from one of the first sheet-supply roller and the second sheet-supply roller in a conveyance direction;

a recording head configured to eject ink onto the recording medium conveyed by the conveyor;

a carriage reciprocable in a main scanning direction perpendicular to the conveyance direction, the recording head being mounted on the carriage;

a drive source configured to generate a drive power by rotating in a forward direction and in a reverse direction;

a switching portion provided outside a recording area in the main scanning direction, the recording area being an area through which the recording medium conveyed by the conveyor passes, a posture of the switching portion being switchable to a first posture and a second posture different from the first posture by contact of the carriage moving in the main scanning direction with the switching portion, the drive power of the drive source being received by the switching portion being in the first posture or the second posture;

a first drive-power transmitting mechanism configured to transmit the drive power of the drive source to the first sheet-supply roller via the switching portion when the switching portion is in the first posture;

a second drive-power transmitting mechanism configured to transmit the drive power of the drive source to the second sheet-supply roller via the switching portion when the switching portion is in the second posture;

an image-recording processing section configured to control the recording head, the carriage, and the conveyor to execute an image recording processing for recording an image on the recording medium on the basis of image data;

a switching processing section configured to execute a switching processing for switching a target of the transmission of the drive power of the drive source from the first drive-power transmitting mechanism to the second drive-power transmitting mechanism or from the second drive-power transmitting mechanism to the first drive-power transmitting mechanism by moving the carriage to contact the switching portion to change a posture of the switching portion;

a forward-and-reverse-rotation processing section configured to execute a forward and reverse rotation processing for rotating the drive source in the forward direction and the reverse direction;

a switching-processing-requirement judging section configured to judge whether a sheet setting of a next-recording recording medium is different from that of a currently-recording recording medium placed on one tray of the first sheet-supply tray and the second sheet-supply tray, and whether the sheet setting of the next-recording recording medium is the same as that of the sheet placed on the other tray of the first sheet-supply tray and the second sheet-supply tray; and a control section configured, where the switching-processing-requirement judging section has judged that the sheet setting of the next-recording recording medium is different from that of the currently-recording recording medium, and the sheet setting of the next-recording recording medium is the same as that of the other tray, to control the switching processing section to start the switching processing in the image recording processing on the currently-recording recording medium by the image-recording processing section and then to control the forward-and-reverse-rotation processing section to execute the forward and reverse rotation processing.

2. The image recording apparatus according to claim 1, wherein the switching processing section is configured to execute the switching processing after a sheet-supply processing is completed for the currently-recording recording medium by the first sheet-supply roller.

3. The image recording apparatus according to claim 1, wherein the switching-processing-requirement judging section includes a moving direction judging section configured to judge whether a moving direction of the carriage in the image recording processing executed by the image-recording processing section coincides with a direction directed toward the switching portion provided outside the recording area, and wherein, where the moving direction judging section has judged that the moving direction of the carriage coincides with the direction directed toward the switching portion, the control section extends a moving distance of the carriage upon the ejection of the ink by the recording head to a position at which the switching portion takes the first posture or the second posture when the carriage contacts the switching portion in the switching processing executed by the switching processing section.

4. The image recording apparatus according to claim 1, further comprising a speed judging section configured to judge whether a moving speed of the carriage in the recording area is equal to or lower than a predetermined speed, wherein, where the speed judging section has judged that the moving speed is not equal to or lower than the predetermined speed, the control section sets the moving speed of the carriage in the switching processing executed by the switching portion, to a speed equal to or lower than the predetermined speed.

5. An image recording apparatus, comprising:

a first sheet-supply tray and a second sheet-supply tray on each of which a recording medium is placed;

a first sheet-supply roller rotatable to supply the recording medium placed on the first sheet-supply tray;

a second sheet-supply roller rotatable to supply the recording medium placed on the second sheet-supply tray;

a conveyor configured to convey the recording medium supplied from one of the first sheet-supply roller and the second sheet-supply roller in a conveyance direction;

a recording head configured to eject ink onto the recording medium conveyed by the conveyor;

a carriage reciprocable in a main scanning direction perpendicular to the conveyance direction, the recording head being mounted on the carriage;

a drive source configured to generate a drive power by rotating in a forward direction and in a reverse direction;

a switching portion provided outside a recording area in the main scanning direction, the recording area being an area through which the recording medium conveyed by the conveyor passes, a posture of the switching portion being switchable to a first posture and a second posture different from the first posture by contact of the carriage moving in the main scanning direction with the switching portion, the drive power of the drive source being received by the switching portion being in the first posture or the second posture;

a first drive-power transmitting mechanism configured to transmit the drive power of the drive source to the first sheet-supply roller via the switching portion when the switching portion is in the first posture;

a second drive-power transmitting mechanism configured to transmit the drive power of the drive source to the second sheet-supply roller via the switching portion when the switching portion is in the second posture;

an image-recording processing section configured to control the recording head, the carriage, and the conveyor to execute an image recording processing for recording an image on the recording medium on the basis of image data a switching processing section configured to execute a switching processing for switching a target of the transmission of the drive power of the drive source from the first drive-power transmitting mechanism to the second drive-power transmitting mechanism or from the second drive-power transmitting mechanism to the first drive-power transmitting mechanism by moving the carriage to contact the switching portion to change a posture of the switching portion;

a forward-and-reverse-rotation processing section configured to execute a forward and reverse rotation processing for rotating the drive source in the forward direction and the reverse direction;

a switching-processing-requirement judging section configured to judge whether the switching processing section needs to execute the switching processing in the image recording processing on one recording medium by the image-recording processing section, where the image recording processing is executed on a plurality of recording media; and a control section configured, where the switching-processing-requirement judging section has judged that the switching processing section needs to execute the switching processing, to control the switching processing section to start the switching processing in the image recording processing on the one recording medium by the image-recording processing section and then to control the forward-and-reverse-rotation processing section to execute the forward and reverse rotation processing, wherein the switching-processing-requirement judging section includes:

a switching-processing-execution judging section configured to judge whether the switching processing has been executed; and a condition judging section configured to judge whether a first condition is satisfied, wherein, where the switching-processing-execution judging section has judged that the switching processing has not been executed and where the condition judging section has judged that the first condition is satisfied, the control section controls the switching processing section to start the switching processing in the image recording processing on the one recording medium by the image-recording processing section and then to control the forward-and-reverse-rotation processing section to execute the forward and reverse rotation processing, and wherein, where the switching-processing-execution judging section has judged that the switching processing has been executed, the control section controls forward-and-reverse-rotation processing section to continue the forward and reverse rotation processing until the forward and reverse rotation processing executed by the forward-and-reverse-rotation processing section satisfies a second condition.

6. The image recording apparatus according to claim 5, further comprising a storage portion configured to store a size of the recording medium placed on each of the first sheet-supply tray and the second sheet-supply tray, wherein, where the image recording processing is to be executed on a plurality of recording media having sizes different from each other and where a size of a recording medium indicated by image data corresponding to the one recording medium on which the image recording processing is being executed is stored in the storage portion as a size of the recording medium placed on one tray of the first sheet-supply tray and the second sheet-supply tray, the condition judging section judges whether the first condition is satisfied, by setting the first condition to a condition that a size of a recording medium indicated by image data corresponding to a recording medium to be recorded next is stored in the storage portion as a size of the recording medium placed on the other tray of the first sheet-supply tray and the second sheet-supply tray.

7. The image recording apparatus according to claim 6, further comprising a display, wherein where the condition judging section has judged that the first condition is not satisfied, the control section controls the display to display thereon that there is no recording medium appropriate for the image recording processing.

8. The image recording apparatus according to claim 5, further comprising:

a storage portion configured to store a size of the recording medium placed on each of the first sheet-supply tray and the second sheet-supply tray;

a presence judging section configured to judge a presence or an absence of the recording medium placed on the first sheet-supply tray or the second sheet-supply tray in the image recording processing on the one recording medium, wherein, where the image recording processing is to be executed on a plurality of recording media having the same as each other, where the presence judging section has judged that no recording medium is placed on one tray of the first sheet-supply tray and the second sheet-supply tray, and where the one recording medium on which the image recording processing is being executed has been supplied from the one tray, the condition judging section judges whether the first condition is satisfied, by setting the first condition to a condition that a size of a recording medium indicated by image data corresponding to a recording medium to be recorded next is stored in the storage portion as a size of the recording medium placed on the other tray of the first sheet-supply tray and the second sheet-supply tray.

9. The image recording apparatus according to claim 5, further comprising an elapsed-time measuring portion configured to measure an elapsed time elapsed from a start of the forward and reverse rotation processing executed by the control section, wherein the control section is configured to judge that the forward and reverse rotation processing does not satisfy the second condition and to continue the forward and reverse rotation processing until the elapsed time measured by the elapsed-time measuring portion exceeds a predetermined length of time.

10. The image recording apparatus according to claim 5, further comprising a rotation-number measuring portion configured to measure the number of the rotation of the drive source in at least one of the forward direction and the reverse direction from a start of the forward and reverse rotation processing executed by the control section, wherein the control section is configured to judge that the forward and reverse rotation processing does not satisfy the second condition and to continue the forward and reverse rotation processing until the number of the rotation measured by the rotation-number measuring portion exceeds a predetermined number.

11. An image recording apparatus, comprising:

a first sheet-supply tray and a second sheet-supply tray on each of which a recording medium is to be placed;

a first sheet-supply roller rotatable to supply the recording medium to be placed on the first sheet-supply tray;

a second sheet-supply roller rotatable to supply the recording medium to be placed on the second sheet-supply tray;

a conveyor configured to convey the recording medium supplied from one of the first sheet-supply roller and the second sheet-supply roller in a conveyance direction;

a recording head configured to eject ink onto the recording medium conveyed by the conveyor;

a carriage reciprocable in a main scanning direction perpendicular to the conveyance direction, the recording head being mounted on the carriage;

a drive source configured to generate a drive power by rotating in a forward direction and in a reverse direction;

a switching portion provided outside a recording area in the main scanning direction, the recording area being an area through which the recording medium conveyed by the conveyor passes, a posture of the switching portion being switchable to a first posture and a second posture different from the first posture by contact of the carriage moving in the main scanning direction with the switching portion, the drive power of the drive source being received by the switching portion being in the first posture or the second posture;

a first drive-power transmitting mechanism configured to transmit the drive power of the drive source to the first sheet-supply roller via the switching portion when the switching portion is in the first posture;

a second drive-power transmitting mechanism configured to transmit the drive power of the drive source to the second sheet-supply roller via the switching portion when the switching portion is in the second posture;

an image-recording processing section configured to control the recording head, the carriage, and the conveyor to execute an image recording processing for recording an image on the recording medium on the basis of image data;

a switching processing section configured to execute a switching processing for switching a target of the transmission of the drive power of the drive source from the first drive-power transmitting mechanism to the second drive-power transmitting mechanism or from the second drive-power transmitting mechanism to the first drive-power transmitting mechanism by moving the carriage to contact the switching portion to change a posture of the switching portion;

a forward-and-reverse-rotation processing section configured to execute a forward and reverse rotation processing for rotating the drive source in the forward direction and the reverse direction;

a switching-processing-requirement judging section configured to judge whether a recording medium in one tray of the first sheet-supply tray and the second sheet supply tray accommodating a currently-recording recording medium is absent, and whether the sheet setting of the next-recording recording medium is the same as that of the sheet placed on the other tray of the first sheet-supply tray and the second sheet-supply tray; and a control section configured, whether the switching-processing-requirement judging section has judged that the recording medium is absent in the one tray of the first sheet-supply tray and the second sheet-supply tray accommodating the currently-recording recording medium, and the sheet setting of a next-recording recording medium is the same as that of the other tray of the first sheet-supply tray and the second sheet-supply tray, to control the switching processing section to start the switching processing in the image recording processing on the currently-recording recording medium by the image-recording processing section and then to control the forward-and-reverse-rotation processing section to execute the forward and reverse rotation processing.

* * * * *